US006421517B1

(12) United States Patent
Nishino et al.

(10) Patent No.: US 6,421,517 B1
(45) Date of Patent: Jul. 16, 2002

(54) TONER SUPPLY DEVICE WITH ROTATABLE AGITATING ELEMENT

(75) Inventors: Toshio Nishino, Yamatokoriyama; Yasuyuki Ishiguro, Higashiosaka; Masatoshi Kaneshige, Ikoma; Hiroshi Tanisawa, Nara; Haruko Yoneda, Tenri; Jun Yamaguchi, Ikoma; Akira Nakakuma, Nara; Naotaka Funayama, Tenri; Tsutomu Nagata, Hirakata; Yoshiaki Sanada, Ikoma, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/874,214

(22) Filed: Jun. 6, 2001

(30) Foreign Application Priority Data

Jun. 6, 2000 (JP) ..... 2000-169641
Jun. 21, 2000 (JP) ..... 2000-186632

(51) Int. Cl.[7] ..... G03G 15/08
(52) U.S. Cl. ..... 399/254; 399/263
(58) Field of Search ..... 399/119, 120, 399/254, 255, 256, 258, 262, 263; 222/DIG. 1

(56) References Cited

U.S. PATENT DOCUMENTS 6,026,263 A * 2/2000 Nakahata et al. ..... 399/263
RE37,542 E * 2/2002 Ichikawa et al. ..... 399/263

FOREIGN PATENT DOCUMENTS

JP 6236110 8/1994
JP 9244368 9/1997

* cited by examiner

*Primary Examiner*—Arthur T. Grimley
*Assistant Examiner*—Hoang Ngo

(57) ABSTRACT

The length of a conveying sheet is set to be greater than the rotational radius of an agitating element so that the distal end of the conveying sheet will slide over the inner wall of the toner container. A slider element having a low frictional resistance is attached at the distal end of the conveying sheet. The slider element preferably has a low coefficient of dynamic friction and is preferably made of a soft resilient material having a thickness smaller than the conveying sheet. Cutouts or openings may be preferably formed at the distal part. A multiple number of ribs are attached to the wall surface of the toner container at the highest position at which the wall and the top plate meet. The ribs are arranged apart from each other in the direction parallel to the agitating shaft of the agitating element. Each rib is a plate-like element projected inward from the wall surface in the toner container with its width put in the direction of the spacing. Further the end portions of the ribs on the interior side of the toner container are adapted to form a curved surface smoothly connecting the top plate surface and the wall surface.

28 Claims, 17 Drawing Sheets

TONER SUPPLY DEVICE WITH ROTATABLE AGITATING ELEMENT

BACKGROUND OF THE INVENTION (1) Field of the Invention

The present invention relates to a toner supply device for a developer unit provided with electrophotographic apparatus such as laser printers, copiers, facsimile machines and the like, in particular relates to a toner supply device which supplies the toner stored in the developer unit to a predetermined site therein with a conveying sheet whilst agitating the toner with a rotatable agitating element.

(2) Description of the Prior Art

Generally, in an electrophotographic printer, a developing device for creating toner images is provided with a toner supply device called a toner hopper. This toner hopper keeps spare toner in reserve and supplies fresh toner to the developing device as the toner is consumed by the development process. Also this toner hopper has an agitating element for agitating the toner therein and conveying the toner into the developing device. This agitating element is called an agitator or toner agitating shaft and functions to agitate the toner to thereby maintain the proper conveyance of toner and prevent the toner from sticking together in a mass or deteriorating in any other way.

This agitating element is generally formed of a relatively hard material such as metal, resin, etc., and is provided in the form of a rigid ladder structure. Hence, the agitating element has little elasticity or flexibility so that only the toner residing within the effective range of its rotational radius can be agitated and conveyed thereby. Therefore, when the toner in the toner hopper reduces to a certain extent, it becomes impossible to convey a sufficient amount of toner to the developing device because of a lower amount of the toner within the reach of the agitating element. Shortage in the amount of toner in the developing device will cause character voids and light print, producing difficulties in forming high quality images. Therefore, in order to keep the amount of toner in the toner hopper at a level greater than a certain amount, it has been necessary to frequently resupply the toner to the toner hopper, which degraded the operating rate of machine, running efficiency and running cost.

In order to solve the above problem, Japanese Patent Application Laid-Open Hei 6 No. 236110, for example, discloses a toner hopper in which a toner conveying element has a: rectangular conveying sheet having a strong elasticity at the distal end thereof so that the sheet will be able to slide over the inner wall surface of the toner hopper. This arrangement enables a sufficient amount of toner to be brought into the developing device even if only a low amount of toner remains in the toner hopper and makes possible effective use of the toner in the toner hopper and can improve the machine operating rate.

FIG. 1A shows a configurational example of this toner hopper 2. Toner hopper 2 in this figure has a toner container 9 for holding the toner and is connected to an unillustrated developing device arranged opposing the photosensitive member by a toner supply portion 10 with a sponge roller 10*a* arranged therein. In this developing device, an unillustrated internal roller is rotationally driven in a predetermined direction by driving means. Toner hopper 2 is enclosed by a top plate 14, a wall surface (side wall) 22 of toner container 9 and a wall surface 23 of toner supply portion 10. FIG. 2A shows shapes of wall surface 22 of toner container 9 and wall surface 23 of toner supply portion 10. Toner container 9 is a receptacle of an approximately rectangular parallelepiped, defined by wall surface 22, unillustrated side walls arranged perpendicular to the wall surface 22 and top plate 14. Toner supply portion 10 is connected to the upper side part of toner container 9 and is enclosed by a groove defined by wall surface 23 of a semi-cylindrical or other shape and top plate 14. An agitating element 11 and conveying sheet 12 as shown in FIG. 2B are arranged in the toner container 9 thus configured.

Agitating element 11 is provided so as to be rotated about an agitating shaft 11*a* which extends in parallel with the rotational axis of the photosensitive drum (the direction indicated by the arrow W in the drawing). In order to perform efficient toner conveyance, conveying sheet 12 made up of a soft resilient material, such as a PET sheet or the like is fixed at its proximal side 12*b* to the distal part of agitating element 11 away from the rotational axis, by double-sided adhesive tape or the like. The distal end, designated at 12*a*, of conveying sheet 12 is formed in parallel with the axial line of agitating shaft 11*a* and bent in the rotating direction. This shape enhances the rigidity of the distal part of conveying sheet 12 hence makes it possible to convey the toner uniformly toward the developing device. When this agitating element 11 is rotated, conveying sheet 12 rotates with its distal part 12*a* kept in contact with the inner wall (the inner surface of top plate 14 and the inner wall surface 22) of toner container 9 while stirring the toner in the toner container 9 and conveying it toward the developing device.

FIGS. 1A to 1F show the actions in the thus configured toner hopper 2 during toner supply. In the drawings, as agitating shaft 11*a* rotates clockwise, conveying sheet 12 deforms holding and conveying the toner with its distal part 12*a* being in sliding contact with the inner wall surface of toner container 9, as shown in FIGS. 1A and 1B. Then, as shown in FIGS. 1C and 1D, the held toner is supplied to toner supply portion 10. Thereafter, conveying sheet 12 moves over the inner side of top plate 14 and transfers its contact point from the sliding movement over top plate 14 to the sliding movement over wall surface 22 as shown in FIGS. 1E to 1F, restarting a next toner holding and conveying cycle.

Since in the above toner hopper 2 conveying sheet 12 is made to slide over the inner wall of toner container 9 in order to make effective use of the toner, the sheet produces contact noise with the inner wall, increasing the noise level. Of such contact noise, the grating sounds arising while the sheet is sliding over the inner wall are not so intense when a relatively large amount of toner is held because the noise is absorbed by the toner. However, as the amount of toner decreases the grating sounds, instead of being absorbed, are heard outside, reaching the user as uncomfortable noise.

One factor that causes the above-described contact noise is a recoiling or grating sound (to called a colliding sound) which arises when conveying sheet 12 abruptly reverts itself back to the original shape due to elastic force and sharply collides with wall surface 22 in the inner space at the meeting point between top plate 14 and wall surface 22 during the action where conveying sheet 12 moves from the state shown in FIG. 1E to the state shown in FIG. 1F, that is, the sheet transfers its contact point from the sliding movement over top plate 14 to the sliding movement over wall surface 22. As the rigidity or mechanical strength of the conveying sheet is enhanced in order to provide more stabilized toner conveyance, this colliding sound becomes more liable to occur and acts as the main source, or cause of the noise. Recently in situations where noise reduction in printer technologies has become more important to meet various needs, there has been a strong demand for sufficient enough countermeasures against noisy sounds of this kind.

Further, there is a risk of the distal part 12*a* of conveying sheet 12 being damaged because the sheet is pressed against the inner wall of toner container 9 and greatly flexed and deformed at that part while agitating element 11 is being rotated. In order to avoid this risk, cutouts 12*c* of various shapes may be formed in the distal part of conveying sheet 12 as shown in FIGS. 3A to 3D. A similar manipulation has been disclosed also in Japanese Patent Application Laid-Open Hei 9 No. 244368. If cutouts 12*c* . . . as shown in the same drawings are formed, the area of conveying sheet 12 in sliding contact with the inner wall of toner-container 9 decreases so that reduction of the grating sound can be expected. Further, the area of conveying sheet 12 colliding with wall surface 22 when the sheet transfers its contact point from the sliding movement over top plate 14 to the sliding movement over wall surface 22 decreases so that the aforementioned colliding sound may be reduced to a certain extent. However, the provision of cutouts 12*c* in conveying sheet 12 will reduce its holding capacity of the toner to a level lower than necessary, making it difficult to uniformly convey the toner from toner container 9 toward the developing device. This may cause degradation of image quality such as light print or low contrast, etc. Also, the shape of conveying sheet 12 becomes complicated lowering profitability.

SUMMARY OF THE INVENTION

The present invention has been devised in view of the above problems, it is therefore an object of the present invention to provide a toner supply device which can reduce the uncomfortable noise generated from the conveying sheet colliding with the inner wall while keeping high enough conveying capability of the toner.

In order to achieve the above object, the present invention is characterized in that a slider element having a low frictional resistance is attached to the distal part of the conveying sheet. That is, a toner supply device, according to the present invention includes: an agitating element for agitating the toner in a toner container; a conveying sheet attached to one end portion of the agitating element and rotating with the agitating element to convey the toner to a predetermined position, wherein the distance from the proximal to the distal end of the conveying sheet is greater than the rotational radius of the agitating element and is set so that the distal end of the conveying sheet is put in sliding contact with the inner wall of the toner container by the agitating element being rotated; and a slider element provided at the distal end of the conveying sheet.

Since the conveying sheet is long enough to come into sliding contact with the inner wall of the toner container, it is possible to improve the toner usage efficiency. The provision of the slider element having a low frictional resistance at the distal end of the conveying sheet makes it possible to reduce the frictional force acting on the inner wall of the toner container during sliding movement. With this arrangement, even when the toner container is filled with a relatively large amount of toner, it is possible to smoothly convey the toner with the conveying sheet while suppressing the stress acting on the toner. Further, when grating sounds become easy to arise as the amount of toner in the toner container has decreased, it is possible to reduce high frequency sounds arising due to sliding contact and hence reduce uncomfortable noise. As a result, it is possible to improve the toner supply device and hence the total quality of the electrophotographic apparatus using it.

The slider element having a low frictional resistance to be attached to the distal end of the conveying sheet preferably has a coefficient of dynamic friction of 0.40 or below, preferably about 0.20 (ASTM D-1894) and a coefficient of static friction of about 0.28 (ASTM D-1894).

Since the slider element is made of a soft resilient material having a rebound resilience of 80% or below, the slider element will deform fitting along the aspect of the inner wall of the toner container when it is put in contact with that inner wall. Therefore, it is possible to keep the frictional resistance low during sliding movement.

The material of the slider element meeting these conditions should be a soft resilient material (a soft and restorable material) with a lower resistance of friction and examples includes: fluororesin tape; ultrahigh molecular polyamide resin film ('POLYSLIDER' a product of ASAHI POLYSLIDER Co. Ltd., etc.); ultrahigh molecular polyethylene resin film with carbon filaments blended therein ('PENRON C954' a product of NTN Corporation, etc.,) and the like. Particularly, polyolefin resin substrate film etc., having a coefficient of dynamic friction of 0.20 (ASTM D-1894) and a coefficient of static friction of about 0.28 (ASTM D-1894) can be preferably used.

In this case, setting the thickness of the slider element smaller than that of the conveying sheet makes it easy for the slider element to deform fitting along the aspect of the inner wall. Further, this thinness is advantageous for frictional resistance. Smallness of the absolute value of the coefficient of dynamic friction and the time-dependent increase of the dynamic friction makes it possible to reduce the loads on the drive system of the agitating element and the stress acting on the toner. Specifically, the thickness of the slider element should be about 30 to 80 $\mu$m or preferably falls within the range of 50±10 $\mu$m.

Because conveyance of the toner is performed by the conveying sheet, there is no need to enhance the strength and rigidity of the slider element, so that no problem of the durability will occur when a thin soft resilient material is used.

Provision of cutouts in the distal part of the slider element makes smaller the contact area between the slider element and the inner wall surface of the toner container. Accordingly, the contact friction can be reduced so that it is possible to enhance the smoothness of the movement of the agitating element and conveying sheet, which leads to efficient conveyance of the toner. As examples of the cutouts capable of reducing the contact friction, a rectangular pattern, wavy pattern, saw-toothed pattern, triangular pattern and other patterns can be adopted.

Alternatively, provision of a series of openings along the distal part of the slider element allows part of the toner to escape through the openings. Therefore, it is possible to reduce the amount of toner scooped by the slider element, so that the resistance (the pressure of the toner) acting on the conveying sheet can be reduced, thus making it possible to smoothen the movement of the conveying sheet and agitating element. The openings are preferably arranged at regular intervals on the slider element in consideration of pressure balance. The openings are preferably provided in a rectangular or circular configuration.

When the slider element is folded in an approximately U-shape and fixed to the conveying sheet by both ends thereof so that the bent part extends beyond the distal part of the conveying sheet and covers the distal part of the conveying sheet, this enables the bent surface of the slider element come into contact with the inner wall of the toner container, hence the state of contact can be stabilized thus making it possible to smoothen the movement of the conveying sheet and agitating element. Further, since the slider element can be fixed firmly by its both ends, it is possible to prevent the slider element from dropping or peeling, thus leading to improvement of reliability.

Moreover, when the distal part of the conveying sheet is bent in the rotational direction to form a bent portion while a slider element is attached to the bent portion so that it extends beyond the bent portion, the conveying sheet can be improved in rigidity and conveyance of the toner. In this case, if a slider element is attached to the reverse side (the side opposite to the rotational direction) of the bent portion, the bent portion would come first into contact with the inner wall surface of the toner container before the slider element. So this arrangement cannot reduce the frictional resistance during sliding movement. Therefore, the slider element is preferred to be attached on the front side of the bent portion, i.e., on the front side in the rotational direction. With this arrangement, the slider element will come first into contact with the inner wall, hence it is possible to reduce the frictional resistance during sliding movement.

In accordance with the present invention, in order to attain the above object, a toner supply device includes: a toner container for holding the toner in a receptacle with a top plate; an agitating element which is rotationally driven in a predetermined direction to agitate the toner in a toner container; a conveying sheet joined to the agitating element and rotating with rotation of the agitating element whilst being deformed with its distal end put in sliding contact with, at least, the top plate of the toner container, the side wall connected to the top plate and the inner wall in contact with the toner, to thereby scoop up and bring the toner to a predetermined position, and is characterized in that curved surface forming member for defining a curved surface smoothly connecting between the top plate surface and the side wall surface is provided at the meeting position between the top plate and the side wall inside the toner container so that the distal end of the deformed conveying sheet comes at least in part into sliding contact with the curved surface forming sites of the curved surface forming member and the full-length of the distal end of the conveying sheet approximately moves over the curved surface.

According to the above invention, the curved surface forming member is provided at the meeting position between the top plate and the side wall inside the toner container. Therefore, when the conveying sheet transfers its contact point from the sliding movement over the top plate to the sliding movement over side wall, the full-length of the distal end of the conveying sheet, as it being deformed, will move over the curved surface defined by the curved surface forming member. The curved surface forming member is made up of either a single component having the curved surface or multiple components defining the surfaces or lines which constitute part of the curved surface.

Accordingly, the deformation of the conveying sheet during the sliding movement over the top plate will not be released abruptly on the interior side of the toner container after the meeting point between the top plate and the side wall. Therefore, the conveying sheet smoothly transfers its contact point from the sliding movement over the top plate to the sliding movement over side wall, whereby it is possible to avoid the conveying sheet colliding with the side wall. Since the conveying sheet need not to have any cutouts and the distal part of the conveying sheet comes into sliding contact the inner wall contacting with the toner, it is possible to hold and convey a sufficient amount of toner in a stable manner.

In this way, it is possible to suppress generation of uncomfortable noise resulting f rom collision of the conveying sheet against the inner wall whilst keeping its capability of conveying a sufficient amount of toner.

Another toner supply device according to the present invention is characterized in that the curved surface forming member is comprised of a multiple number of plate-like ribs, arranged apart from one another in the direction perpendicular to the direction of the sliding movement of the conveying sheet, each rib being projected inward in the toner container from the top plate or from the side wall with its width put in the direction of the spacing and the end portions of the ribs on the interior side of the toner container are adapted to function as the curved surface forming sites.

According to the above invention, since the curved surface forming member is composed of the ribs as above and the end portions on the interior side of the toner container constitute the curved surface forming sites, only limited part of the distal end of the conveying sheet will come in contact with the curved surface forming member. Therefore, this configuration makes it possible to minimize damage to the conveying sheet due to its sliding movement over the curved surface forming member, stress acting on the toner and generation of grating sounds. Further, since the curved surface forming member is constituted by a multiple number of ribs, each being small, production with a metal die can be simplified.

Further, a toner supply device according to the present invention is characterized in that the end portion of each rib on the interior side of the toner container has an end formed of a strip of curved surface that constitutes part of the curved surface and the ridges located at both sides of each end portion with respect to the spacing direction of the ribs are rounded.

According to the above invention, since the end portions of the ribs on the interior side of the toner container or the strips of curved surfaces forming part of the curved surface are adapted to work as the curved surface forming sites while the corners located at both sides of each end portion of the rib with respect to the spacing direction of the ribs are rounded, it is possible to avoid interference of the distal end of the conveying sheet with the ribs. As a result, the distal end of the conveying sheet can smoothly move under reduced resistance to movement, so that it is possible to inhibit the conveying sheet from being damaged by the sliding movement over the curved surface forming member, the toner from being stressed and generation of grating sounds.

A toner supply device according to another aspect of the present invention is characterized in that the end portion of each rib on the interior side of the toner container has a curved ridgeline end that extends in the sliding direction of the conveying sheet and constitutes part of the curved surface and each end is rounded with respect to the direction of the spacing and the cross section of the distal end of each rib cut along a plane perpendicular to the end is angled or tapered on the distal side.

According to the above invention, since the end portions of the ribs on the interior side of the toner container are shaped as the curved ridgelines forming part of the above curved surface and hence are made to function as the curved surface forming sites while the end portions are rounded with respect to the spacing direction of the ribs, it is possible to avoid interference of the distal end of the conveying sheet with the ribs and it is possible to reduce the area of the conveying sheet which comes in sliding contact with the ribs. As a result, the distal end of the conveying sheet can move more smoothly under a further reduced resistance to movement, this configuration, therefore, is more effective in inhibiting the conveying sheet from being damaged due to its sliding movement over the curved surface forming member, the toner from being stressed and generation of grating sounds. Further, the configuration of the ribs being angled or tapered in section provides improvement in the durability of the metal die for producing the ribs of this shape, thus contributing to mass production and low cost.

A toner supply device according to still another aspect of the present invention is characterized in that the end portion of each rib on the interior side of the toner container has a curved ridgeline end that extends in the sliding direction of the conveying sheet and constitutes part of the curved surface and the cross section of the distal end of each rib cut along a plane perpendicular to the end is approximately semicircular on the distal side.

According to the above invention, since the end portions of the ribs on the interior side of the toner container are shaped as the curved ridgelines forming part of the above curved surface and hence are made to function as the curved surface forming sites while the section of the ribs are formed to be approximately semicircular or the end portions are rounded with respect to the spacing direction of the ribs it is possible to avoid interference of the distal end of the conveying sheet with the ribs and it is possible to reduce the area of the conveying sheet which comes in sliding contact with the ribs. As a result, the distal end of the conveying sheet can move more smoothly under a further reduced resistance to movement, this configuration, therefore, is more effective in inhibiting the conveying sheet from being damaged due to its sliding movement over the curved surface forming member, the toner from being stressed and generation of grating sounds. Further, the configuration of the ribs being approximately semicircular in section provides marked improvement in the durability of the metal die for producing the ribs of this shape, thus further contributing to mass production and low cost.

Application of the conveying sheet with its distal end attached with any of the slider elements described above and the curved surface forming member in combination to a toner supply device makes it possible to obtain the combined effects and advantages as described above.

DESCRIPTION OF THE PREFERRED EMBODIMENTS

One embodiment of the present invention will hereinafter be described in detail with reference to the accompanying drawings. The developing device equipped with a toner supply device according to the present embodiment is applied to an electrophotographic apparatus such as a laser printer, copier, facsimile machine, etc., and functions to develop the latent image formed on the photoconductor.

To begin with, the configuration of this developing device will be described.

Figure 4A:
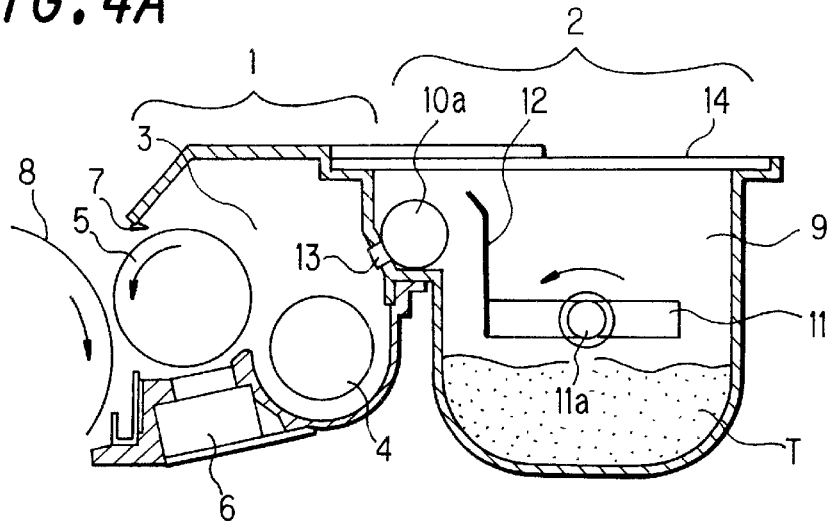
FIG. 4 illustrates one embodiment of a developing device equipped with a toner supply device of the present invention, FIGS. 4A to 4C showing its sequential actions.
Figure 4B:
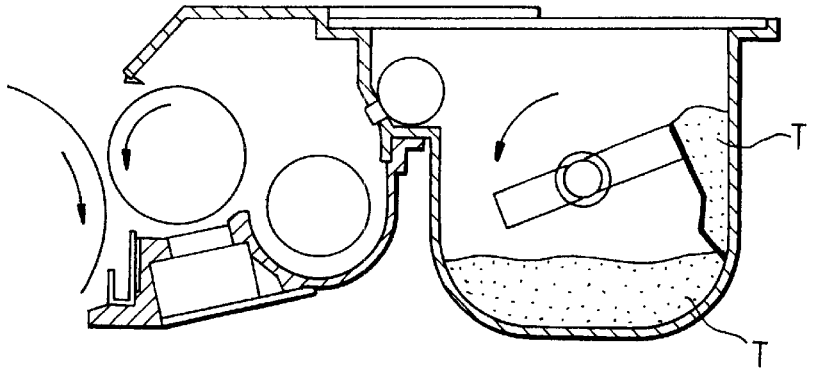
Figure 4C:
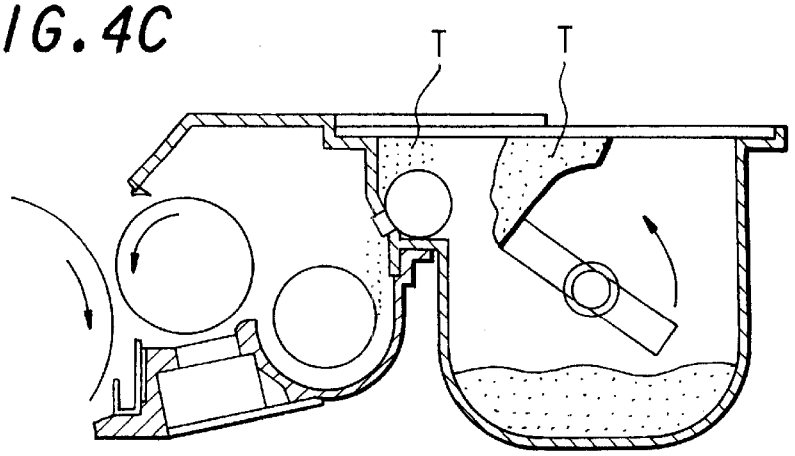

FIGS. 4A to 4C are illustrative views showing the configuration and operation of the developing device. As shown in FIG. 4A, this developing device is made up of a developing portion 1 and a toner hopper (supply portion) 2. Developing portion 1 has an agitating roller 4, developer roller 5, toner sensor 6 and a blade 7, accommodated in a developer chamber 3.

Agitating roller 4 is a roller for agitating toner T in developer chamber 3. Developer roller 5 is a roller for supplying toner T to a photosensitive drum 8. Blade 7 is an element for regulating the thickness of toner T on the surface of developer roller 5. Toner sensor 6 is a magnetic permeability sensor for detecting the toner concentration using a coil.

Toner hopper 2 is configured of a toner supply roller 10*a*, agitating element 11 and conveying sheet 12, all accommodated in a toner container (supply portion) 9 for reserving toner T. Agitating element 11 rotates about an agitating shaft 11*a* to agitate toner T. Conveying sheet 12 is an element made up of a PET sheet attached at one end of agitating element 11 for scooping up toner T in toner container 9 and conveying it to toner supply roller 10*a*. This configuration of the agitating element 11 and conveying sheet 12 will be detailed later.

Toner supply roller 10*a* brings the toner T conveyed by conveying sheet 12 to developer chamber 3 through a toner supply port 13. A top lid 14 is a door which is opened and closed so that toner T may be re-supplied into toner container 9 from outside.

Next, the operation of the developing device will be briefly described. As shown in FIGS. 4A and 4B, in this developing device, agitating element 11 rotates in the direction indicated by the arrow to agitate toner T while conveying sheet 12 scoops up toner T.

During this movement, conveying sheet 12 moves in the rotational direction as it being deformed due to its flexibility and sliding over the inner wall of toner container 9 and top lid 14, as shown in FIGS. 4B and 4C. The moment the sheet departs from top lid 14, it reverts itself back to the original shape due to its elasticity and supplies the toner T held thereon into toner supply roller 10*a*.

Since in the above way this developing device is set such that the distal part of conveying sheet 12 slides over the inner wall of toner container 9, the entire toner T in toner container 9 can be agitated and conveyed. Thus, this configuration makes it possible to improve the usage efficiency of toner T.

Next, the configuration of agitating element 11 and conveying sheet 12 will be described in detail.

Figure 5:
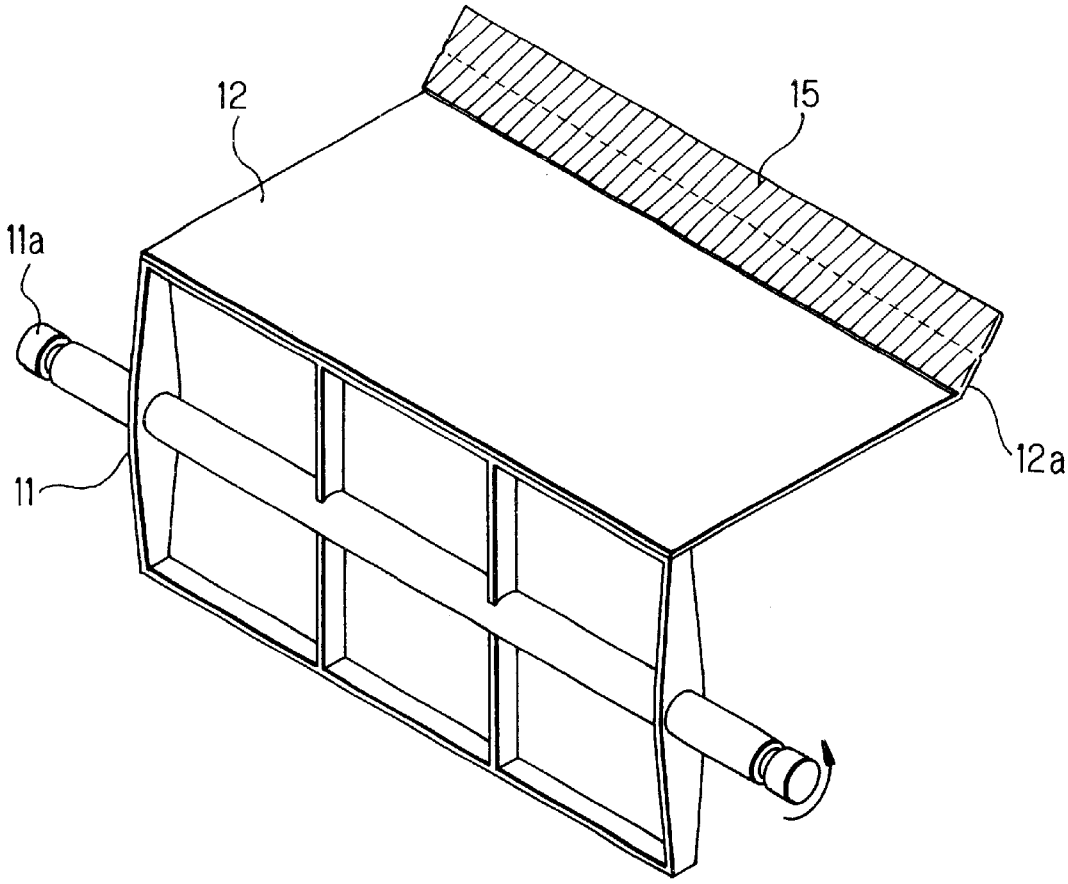
FIG. 5 is a perspective view showing one embodiment of an agitating element and conveying sheet constituting essential parts of a toner supply device according to the present invention.

As shown in FIG. 5, agitating element 11 has a ladder configuration having an agitating shaft 11*a* as a central axis. That is, the agitating element rotates about agitating shaft 11*a*. This agitating element 11 is formed of a relatively hard material such as metal, resin or the like, so that its elastic deformation will be reduced to the smallest possible degree.

Conveying sheet 12 is a PET sheet having a thickness of about 0.125 to 0.188 mm and attached to the distal part of agitating element 11 and has a bent portion 12*a* at its distal end which is bent at a predetermined angle in the rotational direction.

This conveying sheet 12 rotates while being in contact with the inner wall of toner container 9 as agitating element 11 rotates, to thereby scoop up toner T and supply it to toner supply roller 10*a*. Further, provision of bent portion 12*a* on conveying sheet 12 increases the capability of conveying toner T and enhances the strength of conveying sheet 12 itself.

Figure 6:
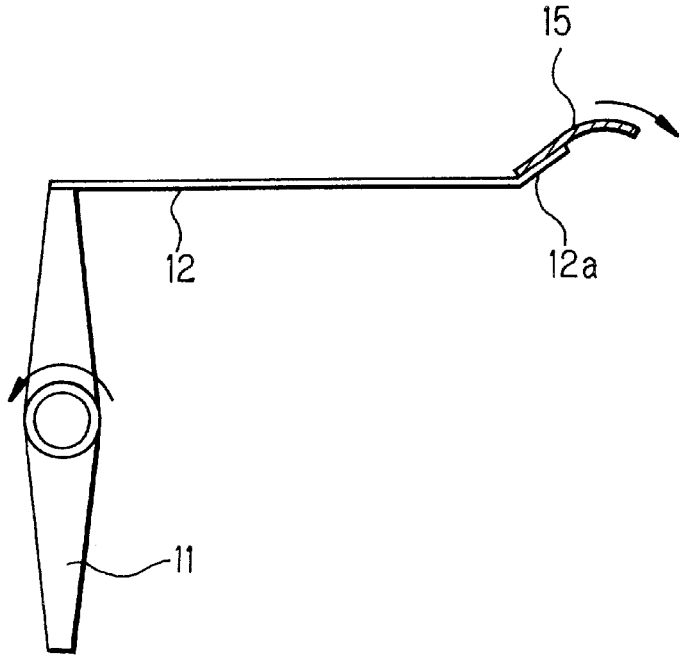
FIG. 6 is a side view showing the same agitating element and conveying sheet.

As shown in FIGS. 5 and 6, a slider element 15 is provided on the surface (on the front with respect to the rotational direction) of bent portion 12*a*. This slider element 15 is a thin plate-like strip is shaped so that it extends outwards beyond the distal part of bent portion 12*a*.

That is, slider element 15 is arranged so as to dome into sliding contact with the inner wall of toner container 9 instead of bent portion 12*a* when agitating element 11 rotates.

This slider element 15 is made-of a soft resilient, material (a soft and restorable material) with a lower resistance of friction than that of conveying sheet 12, such as fluororesin tape, ultrahigh molecular polyamide resin film ('POLYSLIDER' a Product of ASAHI POLYSLIDER Co. Ltd., etc.) ultrahigh molecular polyethylene resin film with carbon filaments blended therein ('PENRON C954' a product of NTN Corporation, etc.,) and the like. This slider element 15 should have a coefficient of dynamic friction of 0.40 or below, preferably about 0.20 (ASTM D-1894) and a coefficient of static friction of about 0.28 (ASTM D-1894). Particularly, polyolefin resin substrate film etc., having a coefficient of dynamic friction of 0.20 (ASTM D-1894) and a coefficient of static friction of about 0.28 (ASTM D-1894) can be preferably used. Since even POM resin (polyacetal resin), which is generally known as showing an excellent sliding performance and a good frictional and abrasive performance among resins, has a coefficient of dynamic friction of about 0.4 to 0.5, it can be understood how excellent the frictional and abrasive performance of the slider element used in the present invention is. Concerning a PET sheet which is often used as the conveying sheet for a device of this kind, it is obvious that it will present a higher coefficient of dynamic friction, hence it will be easily understood that a configuration where conveying sheet 12 directly comes in contact with the inner surface of toner container 9 should be preferably avoided.

For attachment of slider element 15 to conveying sheet 12, adhesives such as epoxy adhesives etc., may be used. For the materials, such as the aforementioned 'PENRON C954', with which adhesive cannot be used should be joined using double-sided tape or the like.

As shown in FIG. 6, when sliding over the inner wall of toner container 9, slider element 15 is set greatly curved along the inner wall of toner container 9 and deforms by tending to wind itself around bent portion 12*a*. Therefore, slider element 15 slides over the inner wall surface of toner container 9 by its large area having low friction and keeps the distal end of bent portion 12*a* out of contact with the inner wall.

The setting of this developing device makes it possible to reduce the frictional force arising with the inner wall surface of toner container 9 while agitating element 11 and conveying sheet 12 are rotating. Therefore, it is possible to realize smooth conveyance of toner T with conveying sheet 12 along with the rotation of agitating element 11. Further, since a soft material presenting a low frictional force is used and brought into sliding contact with toner container 9, it is possible to markedly reduce the high frequency grating sounds arising due to sliding contact with the inner wall of toner container 9. As a result, uncomfortable noise can be reduced, leading to improvement of the developing device and hence the total quality of the electrophotographic apparatus using it.

It is preferred that slider element 15 is made up of a noise absorbing material through which vibrations are hard to transmit. This will further reduce the grating sounds in a more positive manner. The thickness of slider element 15 is preferably set to be smaller than that of conveying sheet 12 from the viewpoint of enhanced flexibility and reduced coefficient of dynamic friction. Specifically, the thickness of the slider element should be about 30 to 80 $\mu$m thick or preferably fall within the range of 50±10 $\mu$m.

With slider element 15 formed of a thin soft resilient material, slider element 15 may easily deform fitting along the configuration of the inner wall of toner container 9 when it comes into contact with the inner wall. This means that the frictional resistance during sliding can be kept smaller. Since conveying sheet 12 and bent portion 12*a* contribute to conveyance of toner T, there is no need to enhance the strength and rigidity of slider element 15.

Figure 7:
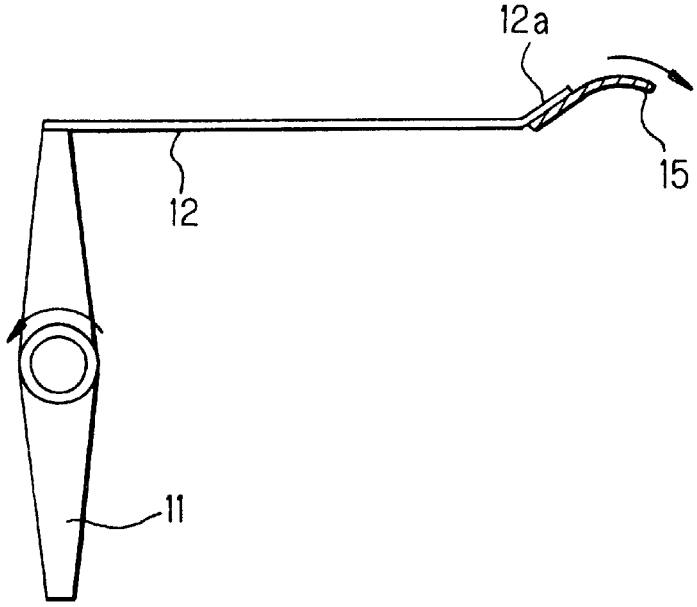
FIG. 7 is an illustration for explaining attachment of a slider element to a conveying sheet.

It is not preferred that slider element 15 is attached to the rear side (the side opposite to the rotational direction) of bent portion 12*a* as shown in FIG. 7. With this configuration, bent portion 12*a* would come first into contact with the inner wall surface of toner container 9 before slider element 15. Therefore, it is impossible to reduce the frictional force during sliding movement.

Figure 8B:
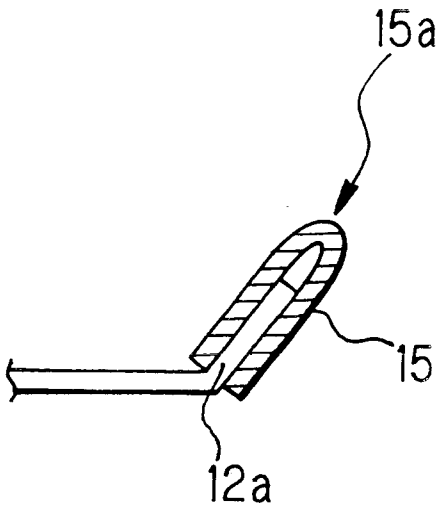
FIG. 8 shows a variational embodiment of an agitating element and conveying sheet, FIG. 8A being a side view and FIG. 8B being a partially enlarged view.
Figure 8A:
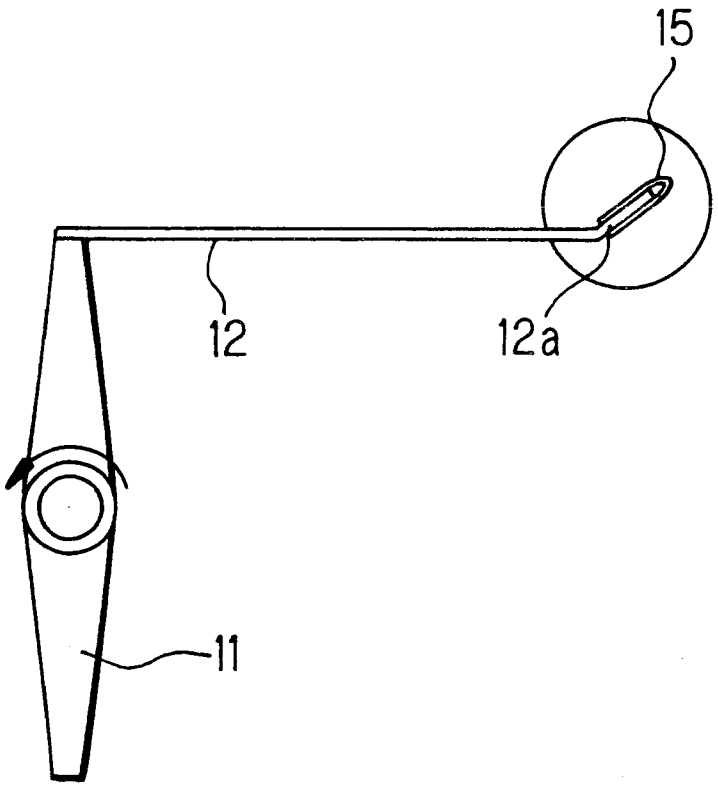

As shown in FIG. 8, slider element 15 may be folded in an approximately U-shape and fixed to the conveying sheet by both ends thereof so that bent part 15*a* extends beyond the distal part of conveying sheet 12 and covers the distal part. In this configuration, since the bent surface of slider element 15 comes into sliding contact with the inner wall of toner container 9, the sliding condition can be stabilized.

Since this configuration makes it possible to keep the frictional force low, it is possible to further enhance the smoothness of the movement of conveying sheet 12 and agitating element 11. Since slider element 15 can be fixed firmly to bent portion 12*a*, it is possible to prevent slider element 15 from dropping or peeling, leading to improvement of reliability.

Figure 9:
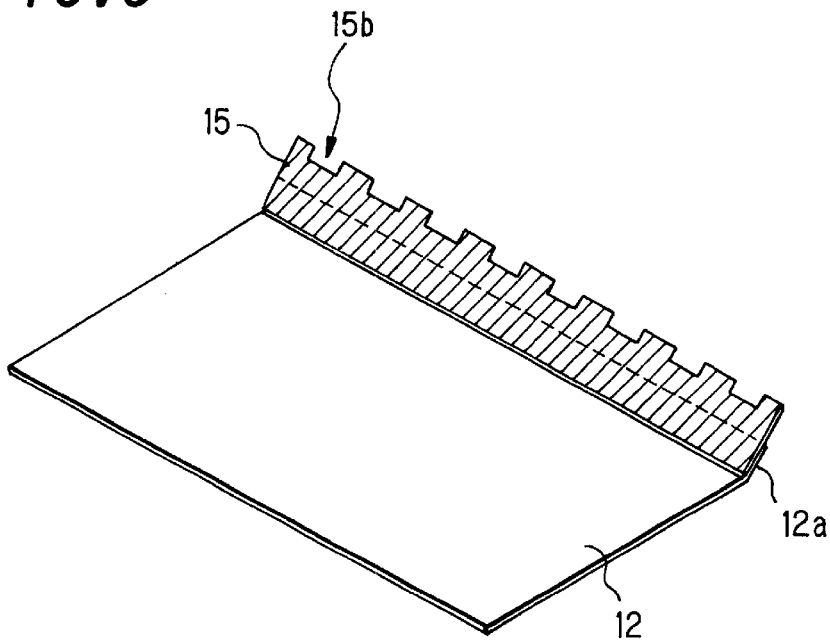
FIG. 9 is a perspective view showing a variational example of a slider element attached to a conveying sheet.
Figure 10A:
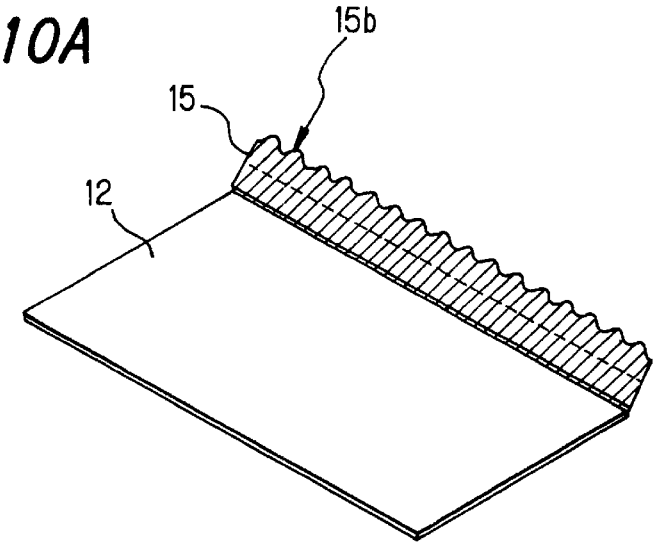
FIG. 10 shows variational examples of a slider element, FIG. 10A showing the state where the element being attached to a conveying sheet, FIG. 10B showing the distal shapes of slider elements.
Figure 10B:
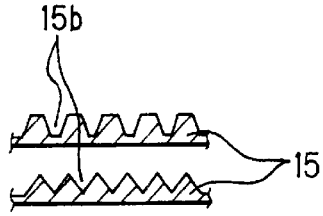

As shown in FIG. 9, the distal edge (the portion in contact with the inner wall of toner container 9) of slider element 15 may be formed with rectangular cutouts 15*b*. This makes smaller the contact area between slider element 15 and the inner wall surface of toner container 9, so that the contact friction can be reduced. This also reduces the amount of toner T scooped by slider element 15. Therefore, the resistance (the pressure of the toner) which originates from the provision of slider element 15 and acts on conveying sheet 12 can be reduced so that it is possible to further enhance the smoothness of the movement of agitating element 11 and conveying sheet 12. Here the shape of cutouts 15*b* is not limited to a rectangular pattern. For example, a wavy pattern shown in FIG. 10A, trapezoidal (saw-toothed) pattern, triangular pattern and the like shown in FIG. 10B may be formed.

Figure 11:
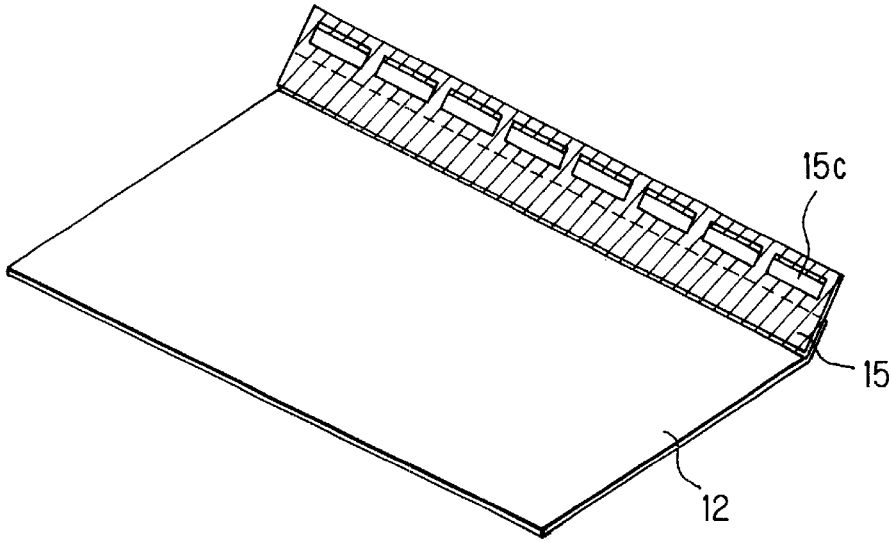
FIG. 11 is a perspective view showing another variational example of a slider element.
Figure 12:
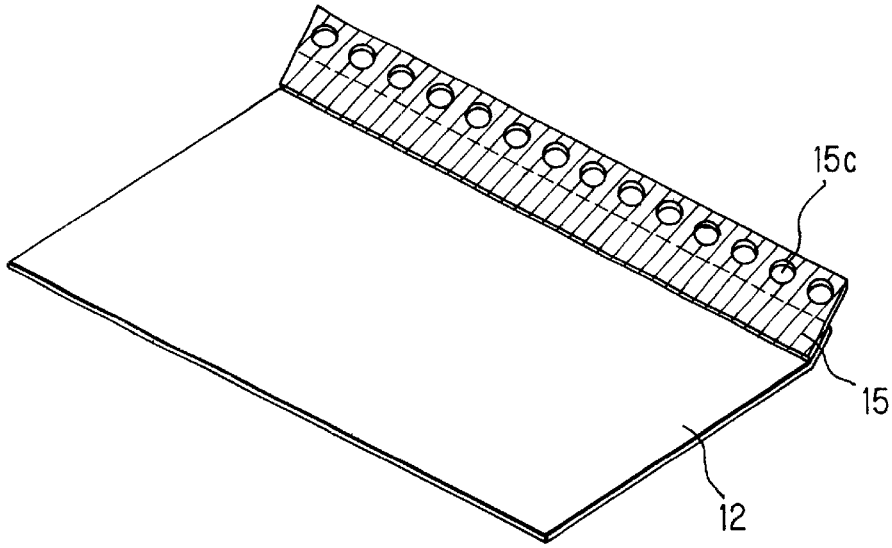
FIG. 12 is a perspective view showing a further variational example of a slider element.

As shown in FIG. 11, it is possible to provide a series of openings 15*c* having a rectangular shape along the distal part of slider element 15. Since this arrangement allows part of toner T to escape through openings 15*c* when conveying sheet 12 is rotated, it is possible to reduce the amount of toner T scooped by slider element 15. Therefore, the resistance (the pressure of the toner) which originates from the provision of slider element 15 and acts on conveying sheet 12 can be reduced so that it is possible to further smoothen the movement of conveying sheet 12 and agitating element 11. Openings 15*c* are preferably arranged at regular intervals on the slider element 15 in consideration of pressure balance. The shape of openings 15*c* is not limited to a rectangle but any shape can be formed as long as toner T is allowed to escape. For example, circular openings 15*c* may be formed as shown in FIG. 12.

Referring next to FIGS. 13 to 19, another embodiment realizing a toner supply device of the present invention will be described. In this embodiment, constituents having the same functions as in the above configuration will be allotted with the same reference numerals without description.

Figure 15A:
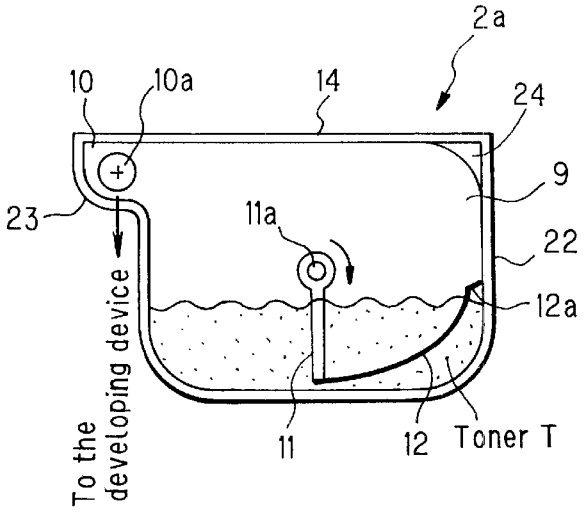
FIGS. 15A to 15F are diagrams for illustrating sequential actions of toner conveyance with a toner supply device having the configuration shown in FIG. 13.
Figure 15D:
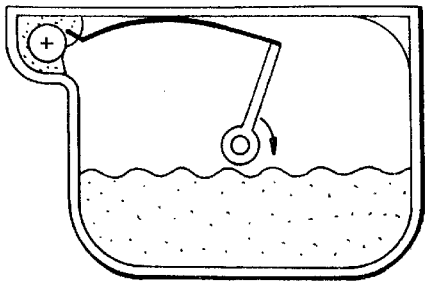
Figure 15B:
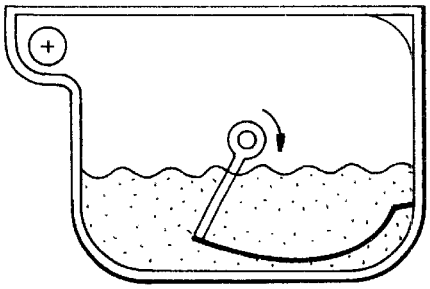
Figure 15E:
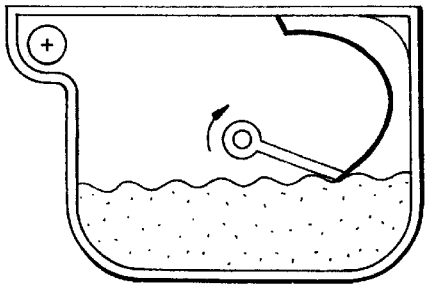
Figure 15C:
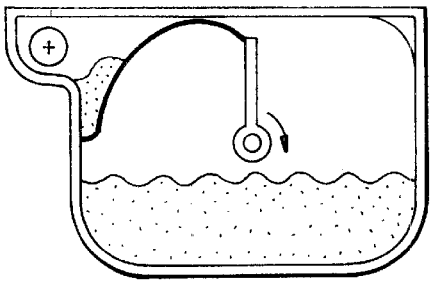
Figure 15F:
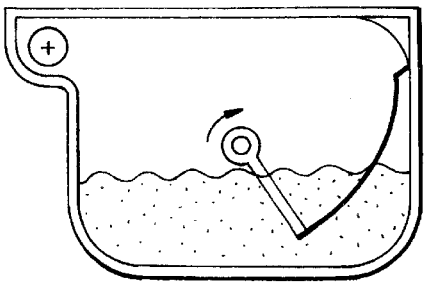

FIG. 15A shows a configuration of a toner hopper 2*a* for a toner supply device. Toner hopper 2*a* has an arrangement shown in FIG. IA to which a multiple number of ribs 24 . . . are added. Top plate 14 is flat so as to suppress the height of toner container 9. Ribs 24 . . . are disposed at the highest position of wall surface 22 of toner container 9 shown in FIG. 13A, where the wall meets top plate 14. These ribs 24 are arranged apart from one another in the direction (the direction indicated by the arrow W in the drawing) parallel to agitating shaft 11*a* of agitating element 11 shown in FIG. 13B, each being a plate-like piece projected inward of toner container 9 from wall surface 22 with its width put in the direction of the spacing. Alternatively, ribs 24 . . . may be attached to top plate 14 so that they project from above toward the interior of toner container 9. The end portions of All these ribs 24 . . . on the interior side of toner container 9, when top plate 14 is placed in contact with wall surface 22, define a curved surface that smoothly connects wall surface 22 and the top plate 14 surface. That is, this curved surface contains as part thereof the end portions of ribs 24 on the interior side of toner container 9 which serve as the curved surface forming sites. Many such curved surfaces can be defined by the end portions of ribs 24 on the interior side of toner container 9, but those ribs will work as long they can approximate a curved surface smoothly connecting the top plate 14 surface with wall surface 22. In this arrangement, when conveying sheet 12 is rotated, the distal end of curved conveying sheet 12 comes in part into sliding contact with the, curved surface forming sites of ribs 24 so that the full length of the distal end of conveying sheet 12 approximately moves along the curved surface. Accordingly, the spacing direction of ribs 24 is also perpendicular to the sliding direction of conveying sheet 12. In this way, ribs 24 function as the curved surface forming member.

Figure 1A:
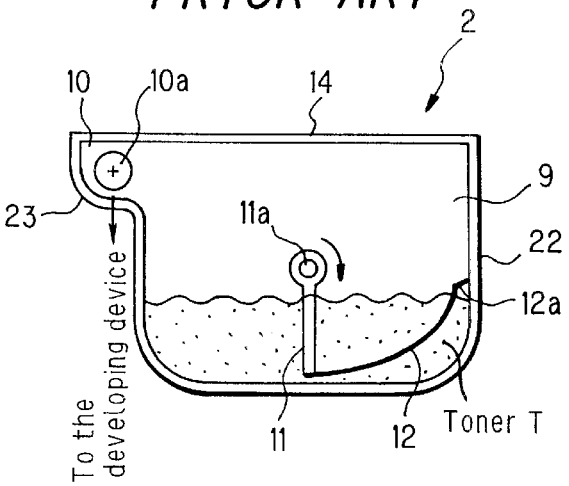
FIG. 1A PRIOR ART
FIGS. 1A to 1F are diagrams for illustrating the sequential actions of toner conveyance with a conventional toner supply device.
Figure 1D:
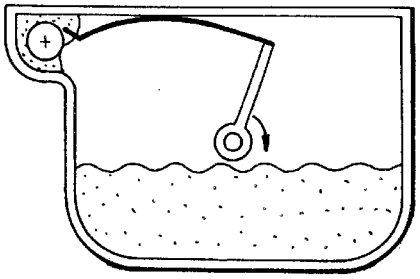
FIG. 1D PRIOR ART
Figure 1B:
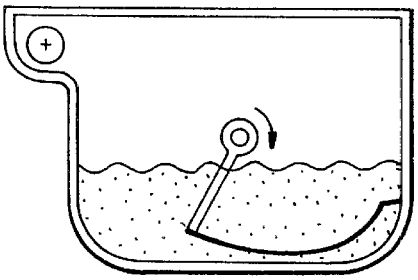
FIG. 1B PRIOR ART
Figure 1E:
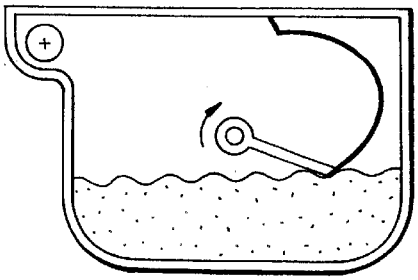
FIG. 1E PRIOR ART
Figure 1C:
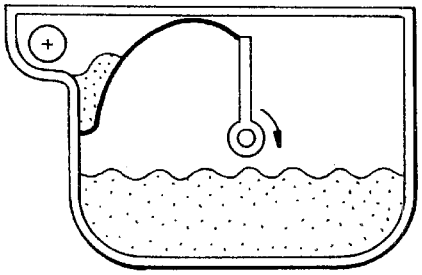
FIG. 1C PRIOR ART
Figure 1F:
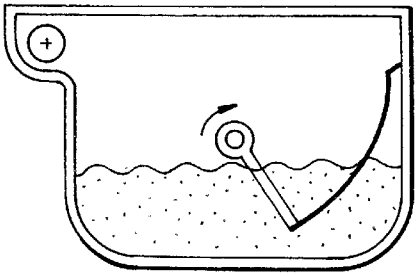
FIG. 1F PRIOR ART
Figure 2A:
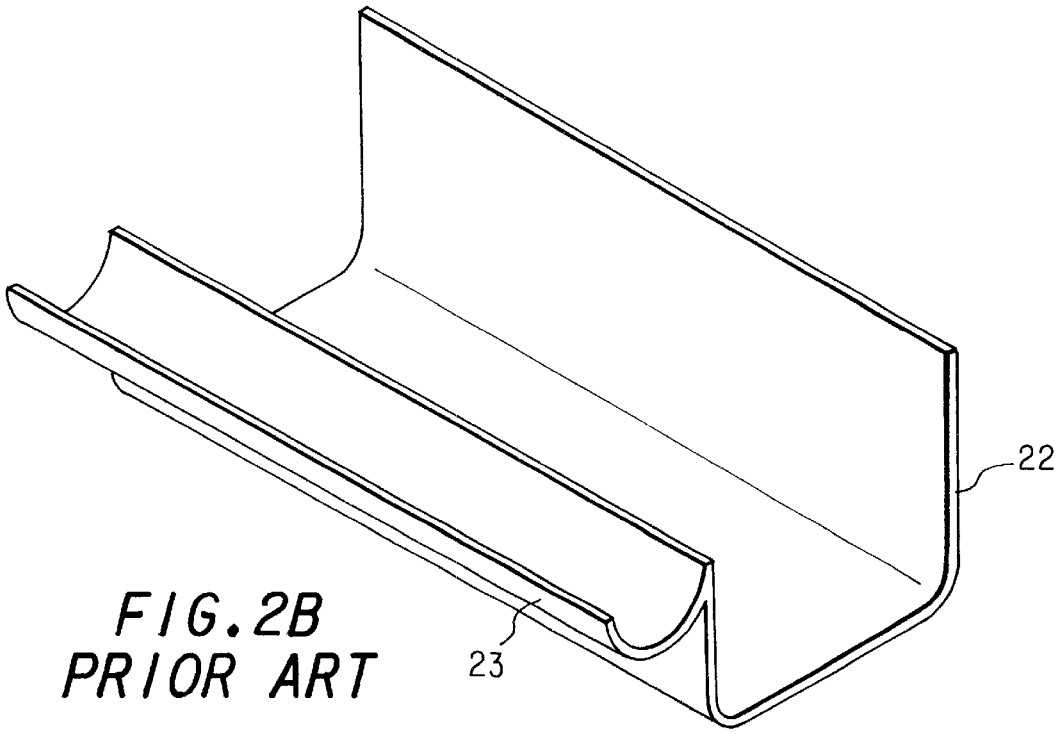
FIG. 2A PRIOR ART
FIGS. 2A and 2B are perspective views showing partial components of a conventional toner supply device.
Figure 2B:
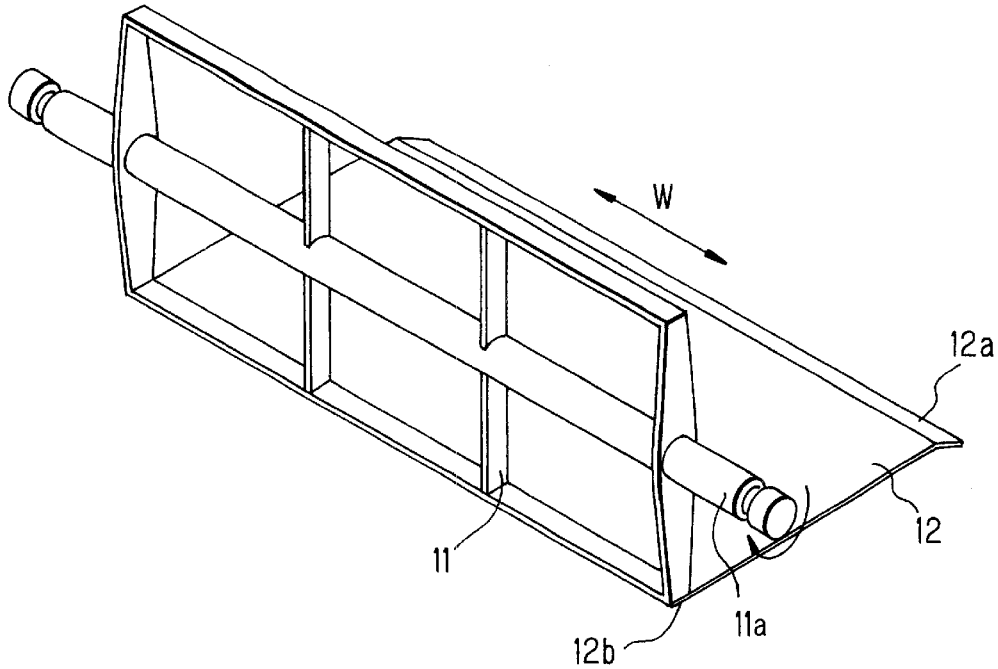
FIG. 2B PRIOR ART
Figure 3A:
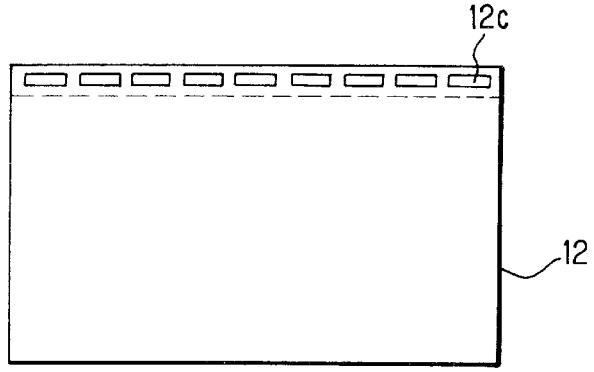
FIG. 3A PRIOR ART
FIGS. 3A to 3D are plan views showing variational examples of a part shown in FIG. 2B.
Figure 3B:
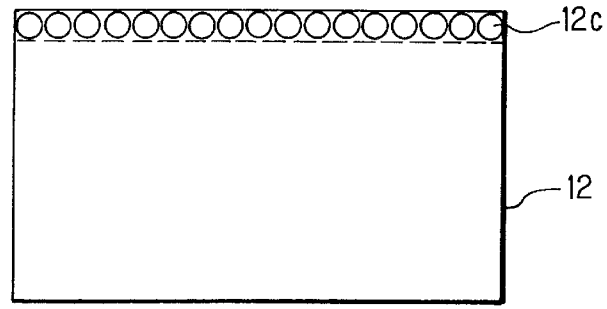
FIG. 3B PRIOR ART
Figure 3C:
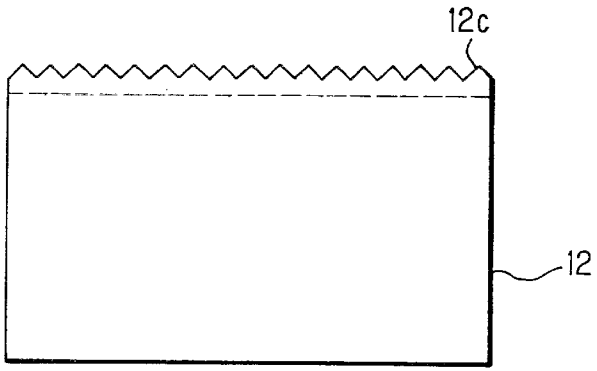
FIG. 3C PRIOR ART
Figure 3D:
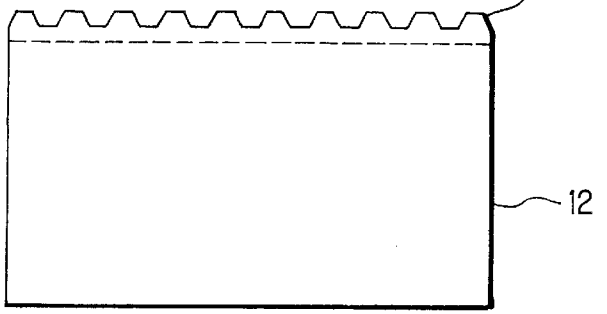
FIG. 3D PRIOR ART
Figure 13A:
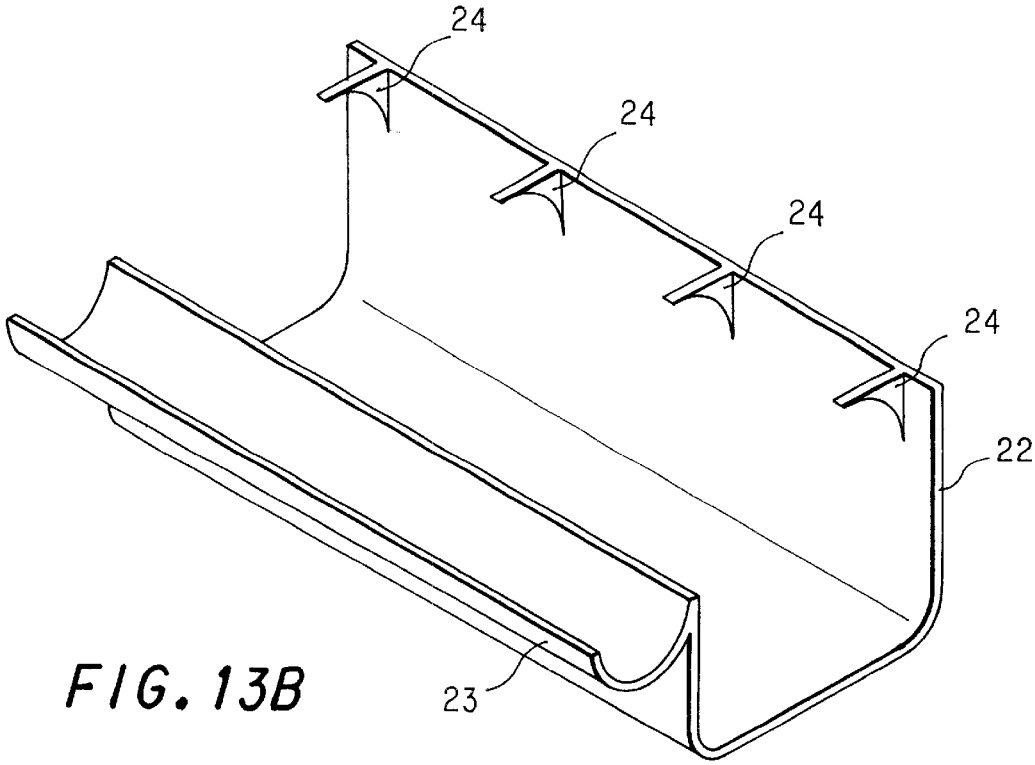
FIGS. 13A and 13B are perspective overall views showing a partial configuration of a toner supply device according to another embodiment of the present invention.
Figure 13B:
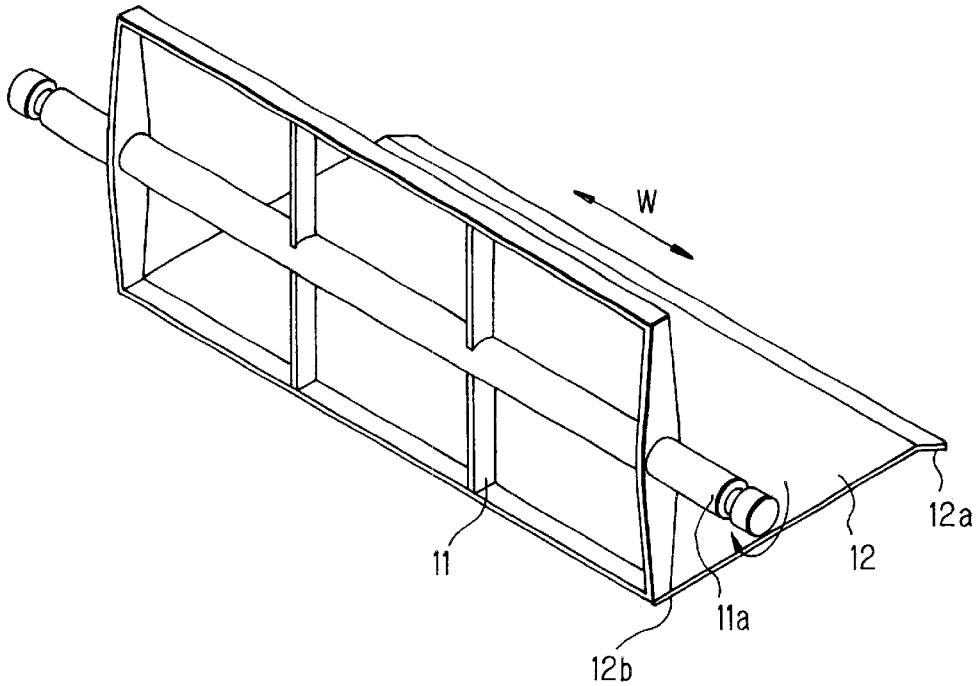
Figure 14:
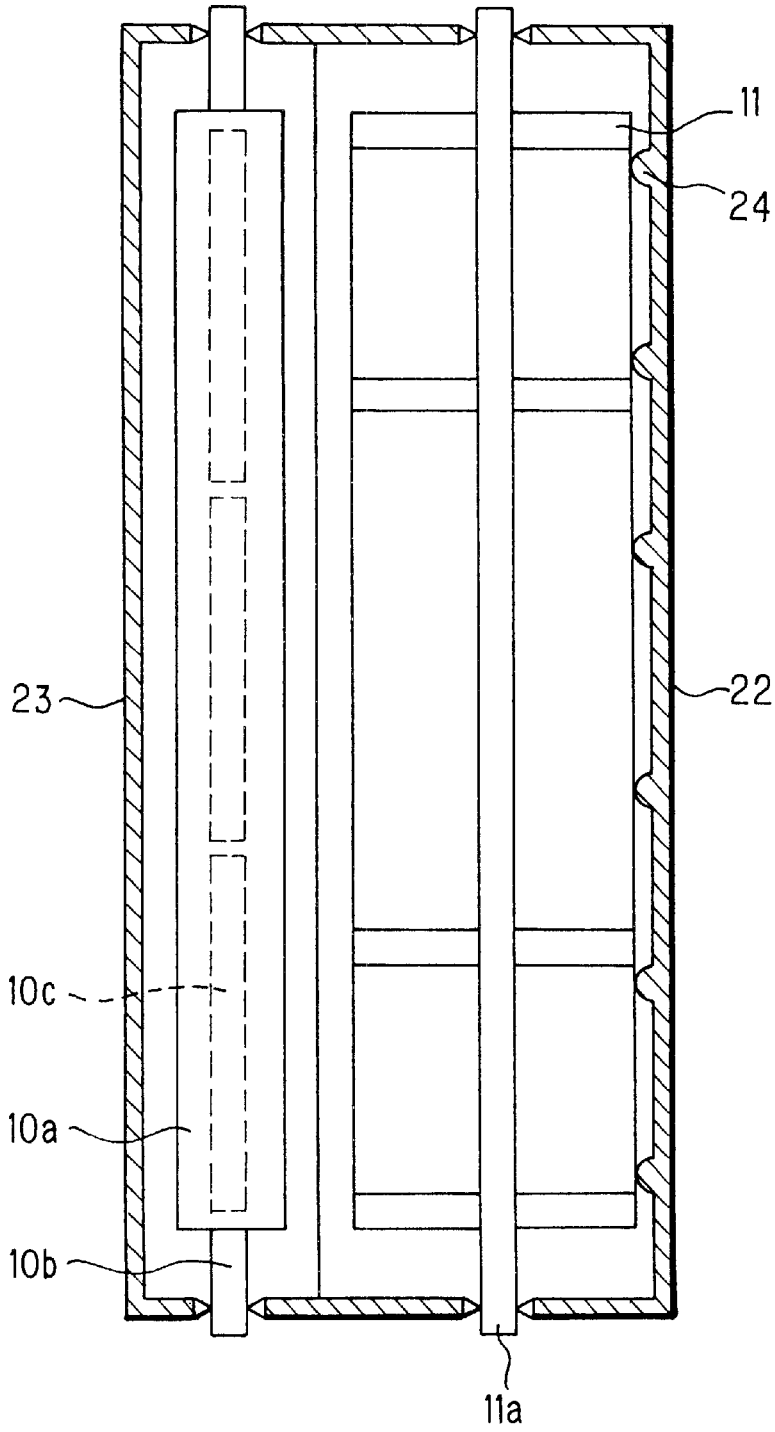
FIG. 14 is a top view showing a toner supply device having the configuration shown in FIG. 13.

Agitating element 11 and conveying sheet 12 shown in FIG. 13B are the same as those shown in FIG. 2B. Here, conveying sheet 12 is, for example, a PET sheet of 0.18 mm thick. The distance from the proximal to distal ends of conveying sheet 12, that is, the distance perpendicular to the direction indicated by the arrow W in the drawing is set greater than the rotational radius of agitating element 11 so that the sheet is able to hold the toner even outside the agitating range of agitating element 11 and supply it to toner supply portion 10. With this setting, it is possible to enlarge the capacity of toner hopper 2*a* and make the best use of the toner. Further, in order to increase the conveyed amount of toner per unit time, a multiple number of conveying sheets 12 may be provided. FIG. 14 shows a top view of the structure shown in FIG. 13B being arranged in toner container 9. A sponge roller 10*a* is arranged in toner supply portion 10 so that the roller can be driven to rotate about a rotary shaft 10*b* parallel to agitating shaft 11*a*. The toner supplied from toner container 9 is supplied to the developing device through the drop holes 10*c* . . . , at the bottom of wall surface 23.

Next, FIGS. 15A to 15F show the sequential actions in the thus configured toner hopper 1 during toner supply. The actions shown in FIGS. 15A to 15D are the same as those shown in FIGS. 1A to 1D. In the steps where conveying sheet 12 transfers its contact point from the sliding movement over top plate 14 to the sliding movement over wall surface 22 shown in FIGS. 15E to 15F, the full length of the distal end of conveying sheet 12, as it is being bent, moves over the approximate curved surface defined by ribs 24 . . . , by virtue of provision of ribs 24 at the meeting point between top plate 14 and wall surface 22 inside toner container 9. In FIGS. 15A to 15F, the sectional shape of the above curved surface, cut across a plane perpendicular to agitating shaft 11*a*, is shown. Conveying sheet 12 is set maximally curved at the stage shown in FIG. 15E and the deformation is gradually released as the distal end of conveying sheet 12 moves along the curved surface and is set less deformed at the stage shown in FIG. 15F.

In this way, the deformation of conveying sheet 12 during the sliding movement over top plate 14 will not be released abruptly on the interior side of toner container 9 after the meeting point between top plate 14 and wall surface 22. Therefore, conveying sheet 12 is able to smoothly transfer its contact point from the sliding movement over top plate 14 to the sliding movement over wall surface 22, whereby it is possible to avoid conveying sheet 12 colliding with wall surface 22. Since conveying sheet 12 having no cutouts as stated above slides over the inner wall in contact with the toner, it is possible to hold and convey a sufficient amount of toner in a stable manner. In this way, it is possible to suppress generation of uncomfortable noise resulting from collision of conveying sheet 12 against the inner wall whilst keeping its capability of conveying a sufficient amount of toner.

Figure 16A:
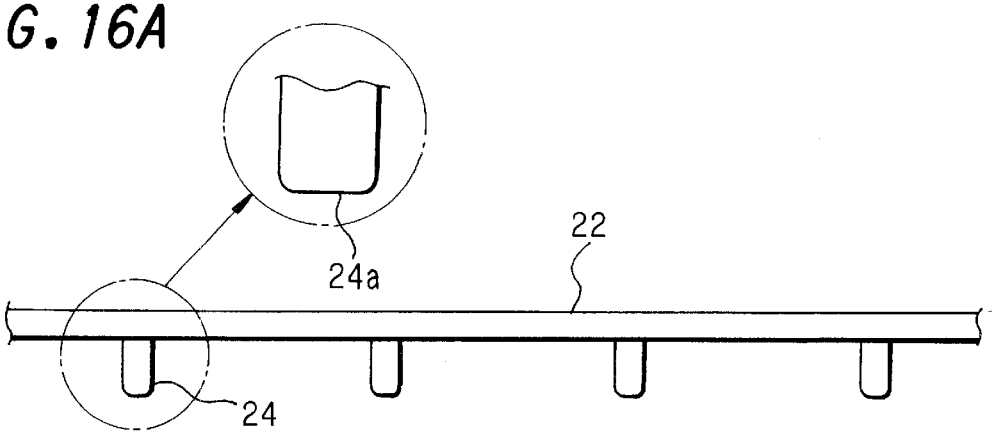
FIGS. 16A to 16C are sectional views showing the shapes of ribs provided for a toner supply device having the configuration shown in FIG. 13.

Next description will be made of the shape of the end portions of ribs 24 . . . on the interior side of toner container 9, as the curved surface forming sites. FIG. 16A shows an example where the end portion of each rib 24 on the interior side of toner container 9 has an end 24*a* formed of a strip of curved surface that constitutes part of the above-mentioned curved surface. This drawing is a sectional view cut along a plane perpendicular to the ends 24*a* . . . Any section of to end face 24*a* cut along any plane as long as it is perpendicular to ends 24*a* . . . has the same shape, or approximately square shape, as the sectional shape of rib 24 of the drawing. The ridges located at both sides of each end portion with respect to the spacing direction of ribs 24 . . . are rounded. Since the ends 24*a* . . . or the strips of curved surfaces forming part of the curved surface are adapted to work as the curved surface forming sites while the corners located at both sides of each end 24*a* with respect to the spacing direction of ribs 24 . . . are rounded, it is possible to avoid interference of the distal end of conveying sheet 12 with ribs 24 . . . As a result, the distal end of conveying sheet 12 can smoothly move under reduced resistance to movement, so that it is possible to inhibit conveying sheet 12 from being damaged, being stressed by the toner and generating grating sounds, due to its sliding movement over ribs 24 . . .

Figure 16B:
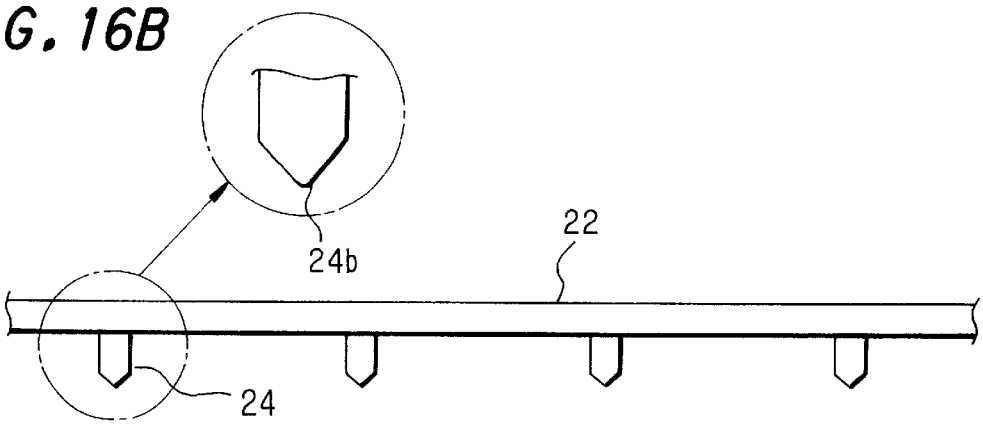

FIG. 16B shows an example where the end portion of each rib 24 on the interior side of toner container 9 has a curved ridgeline end 24*b* that extends in the sliding direction of conveying sheet 12 and constitutes part of the above-mentioned curved surface. This curved ridge line is similar to the curved line of ribs 24 . . . on the interior side of toner container 9 shown in FIGS. 15A to 15F. The manner of creating the sectional view is the same as in FIG. 16A. Each end 24*b* is rounded with respect to the spacing direction of ribs 24 . . . and the shape of the cross section of the distal end of each rib 24 is angled or tapered. Since the ends 24*b* . . . or the curved ridgelines forming part of the curved surface are adapted to work as the curved surface forming member while the ends 24*b* . . . are rounded with respect to the spacing direction of ribs 24 . . . , it is possible to avoid interference of the distal end of conveying sheet 12 with ribs 24 . . . Further, the sliding part of conveying sheet 12 which comes in contact with ribs 24 . . . during its sliding movement over the ribs becomes smaller in area than that in the case of FIG. 16A. As a result, the distal end of conveying sheet 12 can move more smoothly under a further reduced resistance to movement compared to the case shown in FIG. 16A. Therefore, this configuration is more effective compared to the case shown in FIG. 16A in inhibiting conveying sheet 12 from being damaged, being stressed by the toner and generating grating sounds, due to its sliding movement over ribs 24 . . . Further, the configuration of ribs 24 . . . being angled or tapered in section, provides improvement in the durability of the metal die for producing the ribs 24 . . . of this shape, thus contributing to mass production and low cost of ribs 24 . . .

Figure 16C:
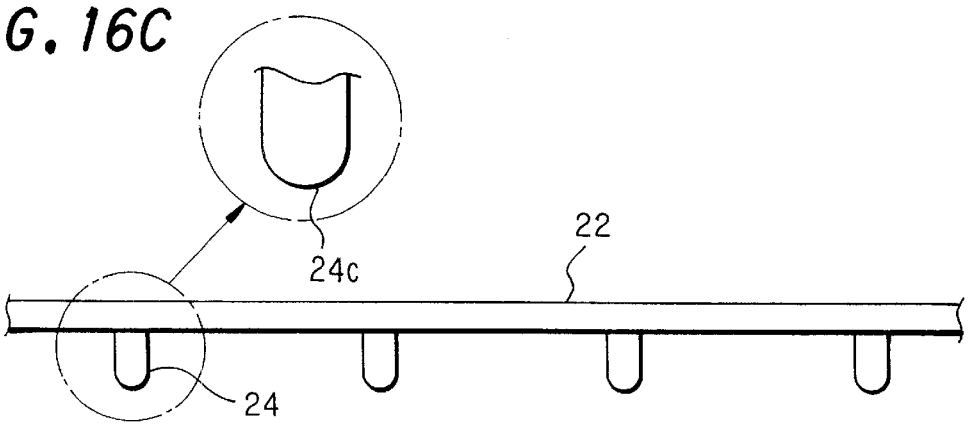

FIG. 16C shows an example where the end portion of each rib 24 on the interior side of toner container 9 has a curved ridgeline end 24*c* that extends in the sliding direction of conveying sheet 12 and constitutes part of the above-mentioned curved surface and the shape of each rib 24 cut along a plane perpendicular to the ends 24*c* . . . is approximately semicircular on the projected side. Since the ends 24*c* . . . or the curved ridgelines forming part of the curved surface are adapted to work as the curved surface forming sites while the sections of ribs 24 . . . are formed to be approximately semicircular hence the ends 24*c* . . . are rounded with respect to the spacing direction of ribs 24 . . . , it is possible to avoid interference of the distal end of conveying sheet 12 withribs 24 . . . Further, as in the case of FIG. 16B the sliding part of conveying sheet 12 which comes in contact with ribs 24 . . . during its sliding movement over the ribs becomes smaller in area than that in the case of FIG. 16A. As a result, the distal end of conveying sheet 12 can move more smoothly under a further reduced resistance to movement compared to the case shown in FIG. 16A. Therefore, this configuration is more effective compared to the case shown in FIG. 16A in inhibiting conveying sheet 12 from being damaged, being stressed by the toner and generating grating sounds, due to its sliding movement over ribs 24 . . . Further, the configuration of the sections of ribs 24 . . . being formed to be approximately semicircular, provides marked improvement in the durability of the metal die for producing the ribs of this shape, thus further contributing to mass production and low cost of ribs 24 . . .

Any of the above ends 24*a* . . . , 24*b* . . . and 24*c* . . . shown in FIGS. 16A to 16C approximates a curved surface smoothly connecting top plate 14 and wall surface 22 as stated above. Therefore, there is a fear that the distal end of conveying sheet 12 might undulate between ribs 24 . . . and may not move along the intended curved surface when the spacing interval of ribs 24 . . . is set to be too large. In such a case, the spacing interval of ribs 24 . . . should be set depending on the rigidity of the distal part 12*a* of conveying sheet 12.

Figure 17A:
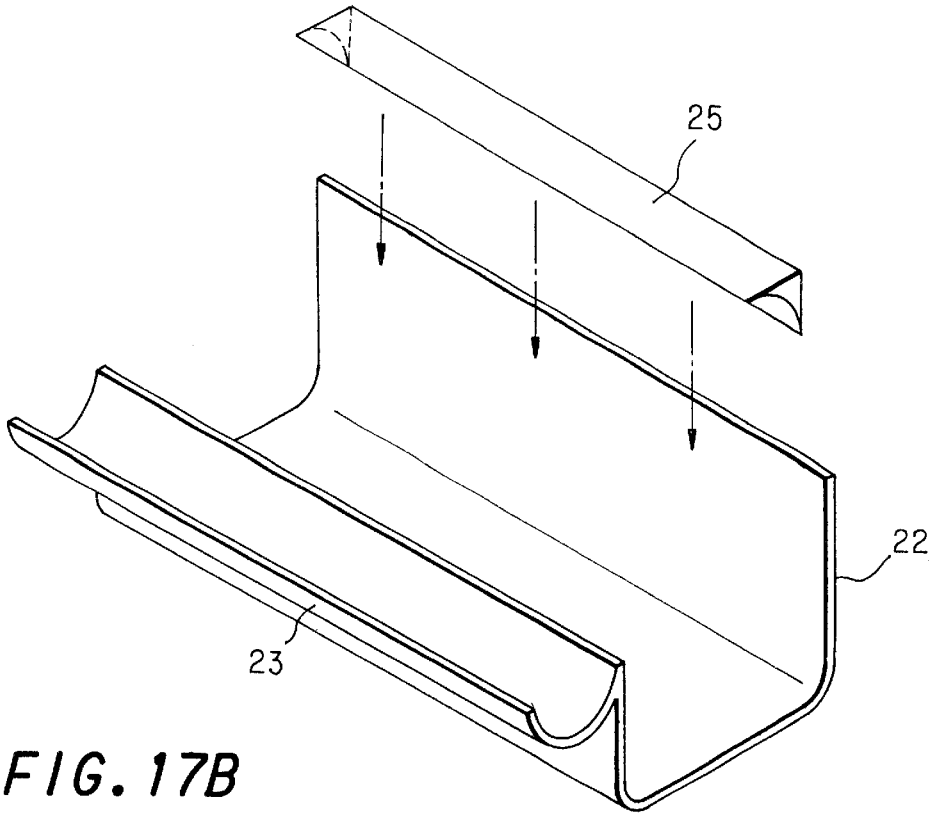
FIGS. 17A and 17B are overall perspective views showing partial components of a first variational example of a toner supply device of the present invention.
Figure 17B:
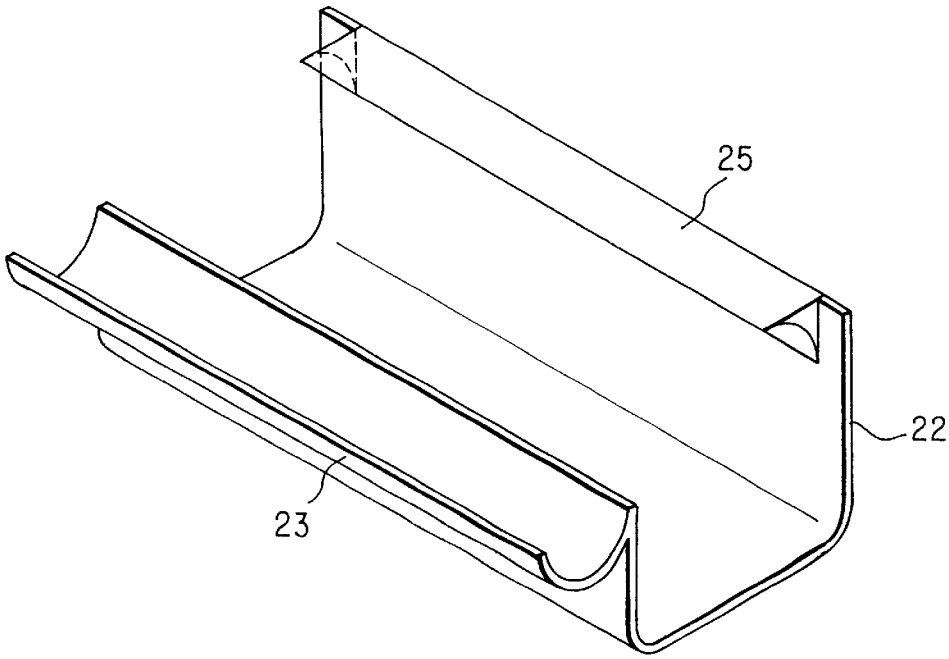

Though in the above examples, multiple ribs 24 . . . arranged apart from one another as the curved surface forming member, a single rib 25 which has the curved surface that smoothly connects top plate 14 and wall surface 22 as the end portion on the interior side of toner container 9 may be provided, as shown in FIG. 17A. This rib 25 should be attached either at the highest position of wall surface 22 as shown in FIG. 17B or attached to the top plate 14 (not shown) in alignment with the meeting line with wall surface 22. This corresponds to a configuration in which the multiple ribs 24 . . . are made continuous with respect to the direction perpendicular to the direction of sliding movement of conveying sheet 12. In this case, the distal end of conveying sheet 12 moves over the curved surface defined by rib 25 exactly, so that it is possible to reliably prevent generation of colliding sounds of conveying sheet 12. However, it should be noted that the configuration where multiple ribs 24 are used as the curved surface forming member makes it possible to minimize damage to conveying sheet 12, stress acting on the toner and generation of grating sounds, compared to the case of a single rib 25 because the distal end of conveying sheet 12 which comes in contact with the curved surface forming member during its sliding movement is smaller in area than that in the case of rib 25. Further, since each rib 24 is small when the curved surface forming member is constituted by multiple ribs 24 . . . production with a metal die can be simplified.

Figure 18A:
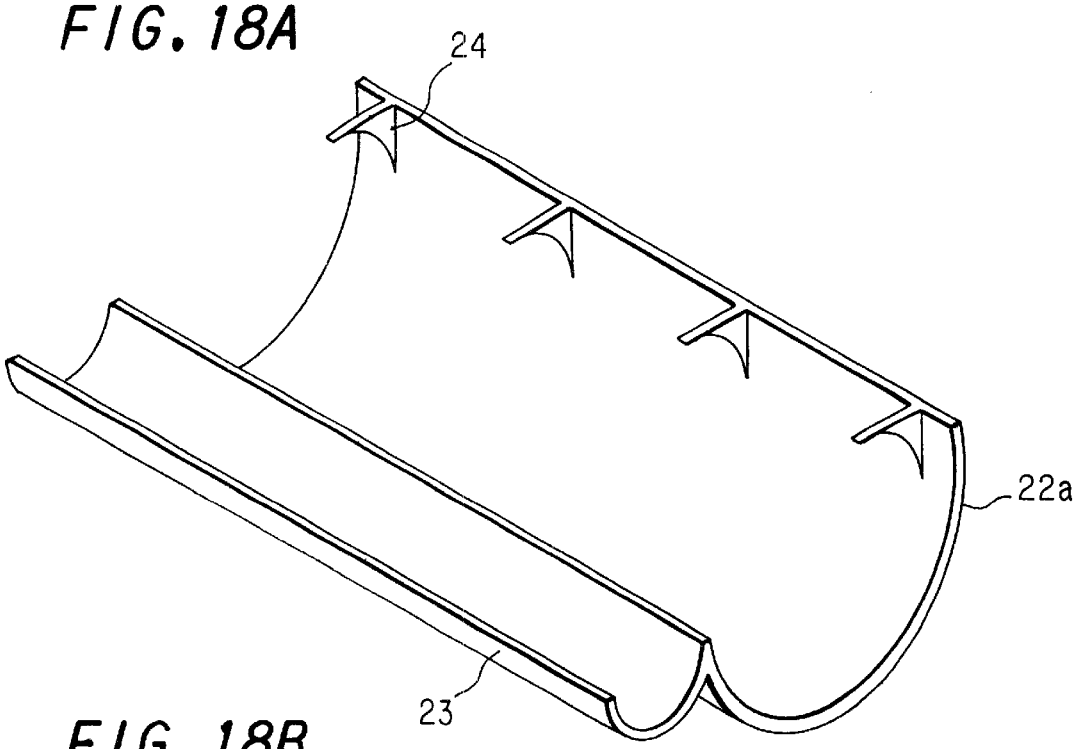
FIGS. 18A and 18B are overall perspective views showing partial components of a second variational example of a toner supply device of the present invention.
Figure 18B:
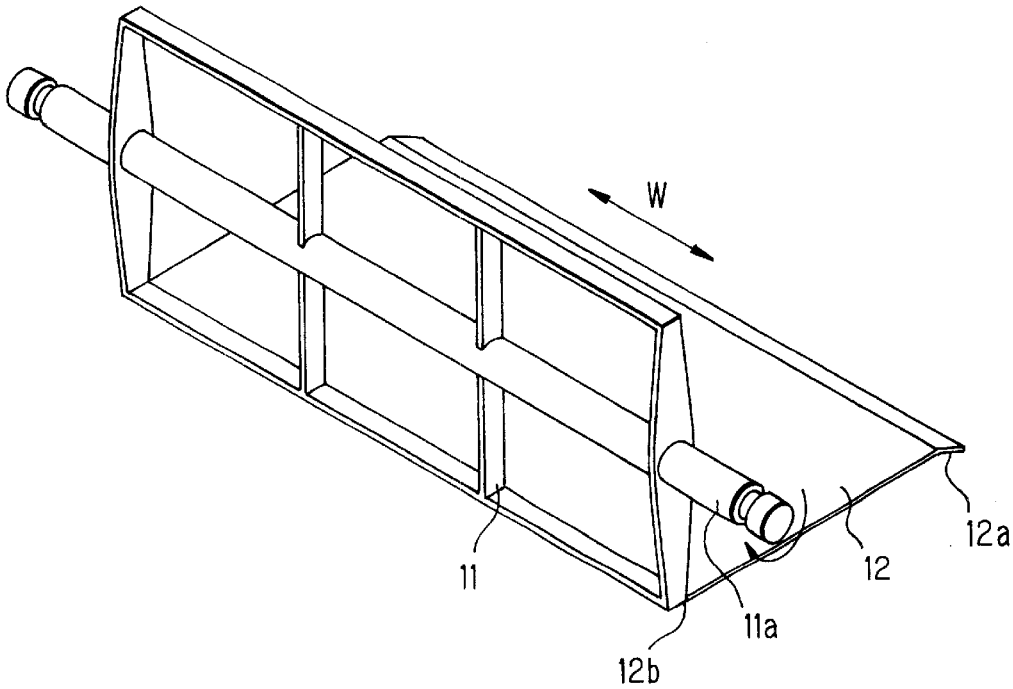
Figure 19A:
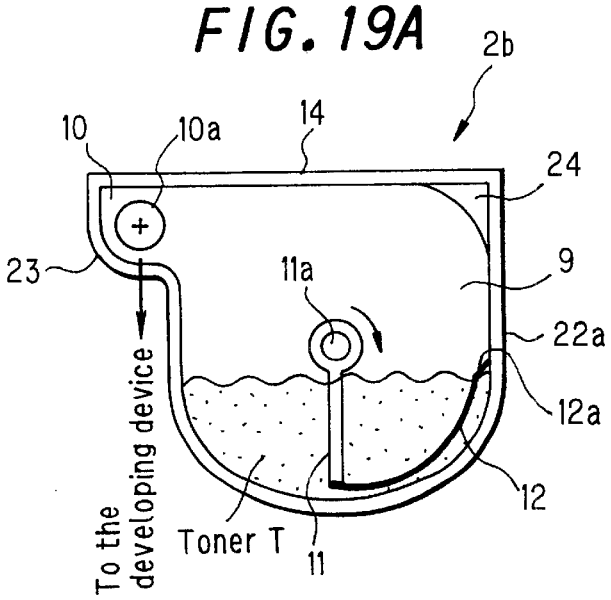
FIGS. 19A to 19F are diagrams for illustrating the sequential actions of toner conveyance with a toner supply device having the configuration shown in FIG. 18.
Figure 19B:
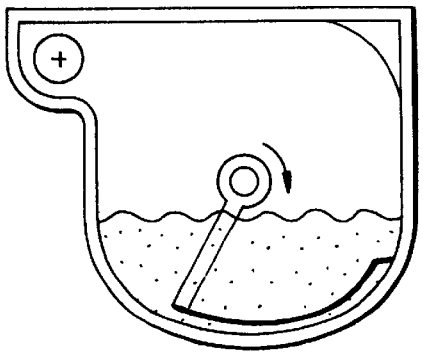
Figure 19C:
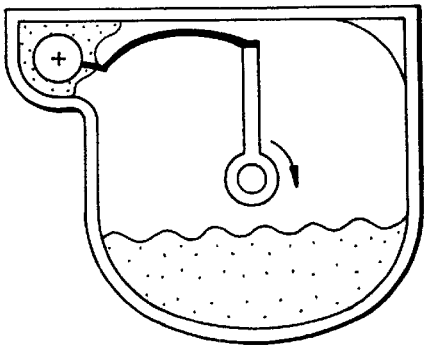
Figure 19D:
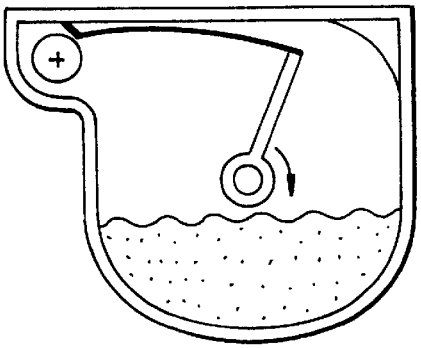
Figure 19E:
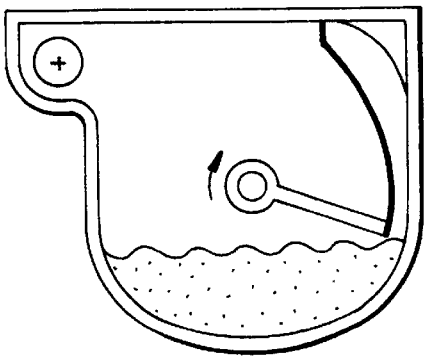
Figure 19F:
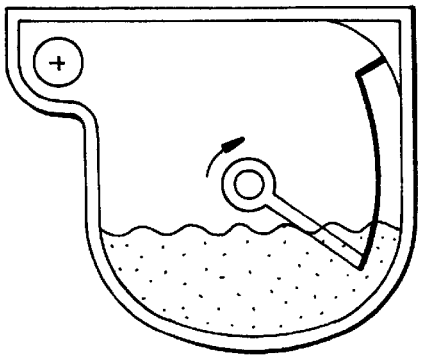

As shown in FIG. 18A, the lower part of toner container 9 is preferably formed by providing a semi-cylindrical wall surface 22*a* with its axis in parallel with the direction (the direction of the arrow W in FIG. 18B) of agitating shaft 11*a*. In the toner container 9 formed with wall surface 22*a*, agitating element 13 and conveying sheet 12 similar to those shown in FIG. 13B are provided as shown in FIG. 18B. FIGS. 19A to 19F show the sequential actions in the thus configured toner hopper 2 during toner conveyance. As seen in FIGS. 19A and 19B, the distal end of conveying sheet 12 can smoothly move along the approximately semicircular inner wall even when the toner is scooped up and conveyed through the toner pool, so that it is possible to reduce generation of sounds originating from scratching. The operations of FIGS. 19C to 19F are the same as those of FIGS. 15A to 15F.

In the description heretofore, the toner supply devices using a conveying sheet having various slider elements attached to the distal end thereof and the toner supply devices using a curved surface forming member have been illustrated. The combined effects and advantages can be obtained by the combination of slider element 15 and curved surface forming member 24(25), as is shown in FIGS. 20 and 21.

Figure 20:
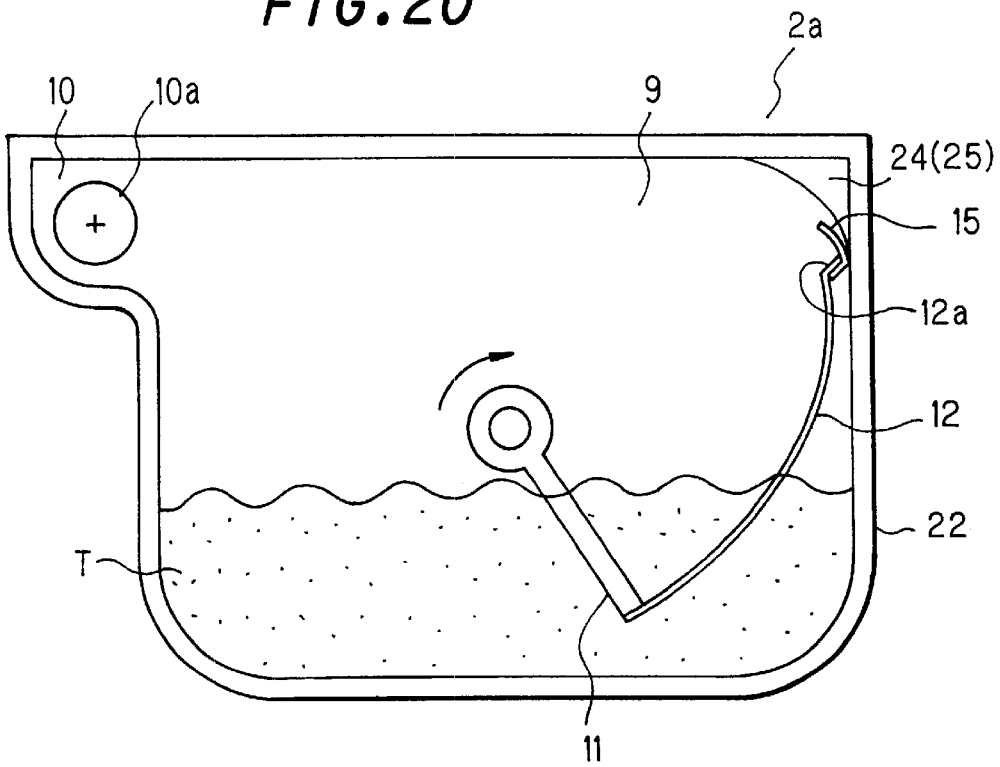
FIG. 20 is an illustrative view for explaining the operation of a toner supply device wherein a conveying sheet having a slider element attached at the distal end thereof and a curved surface forming member are used in combination.
Figure 21:
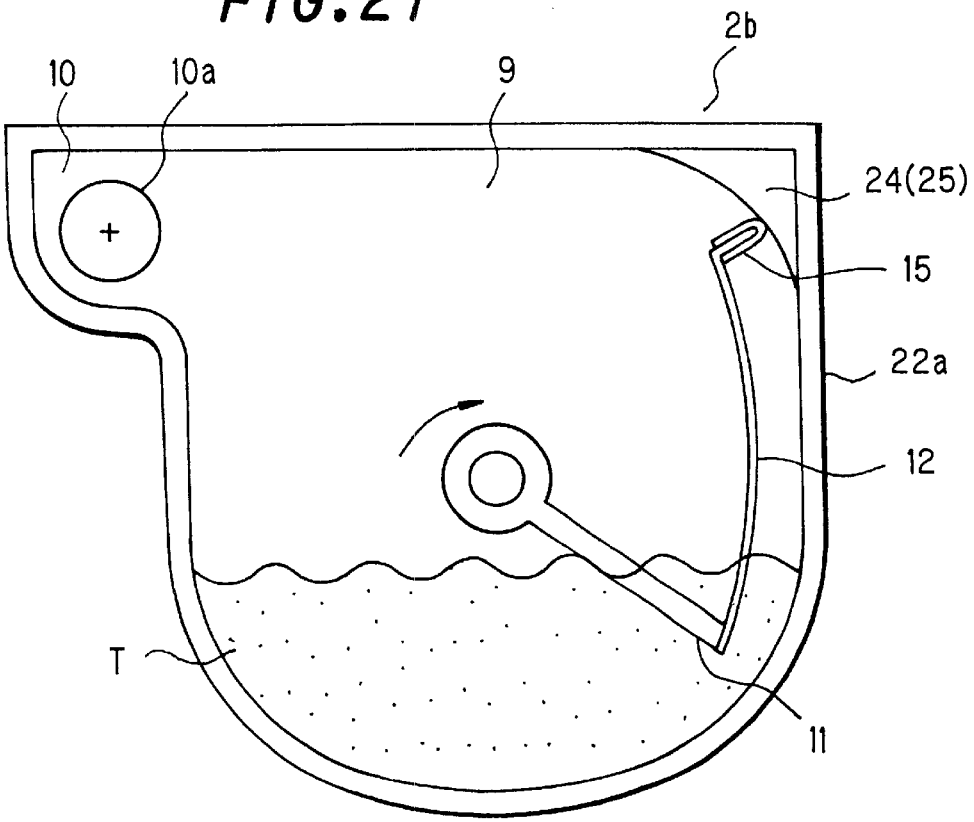
FIG. 21 is an illustrative view for explaining the operation of a toner supply device wherein a conveying sheet having a slider element attached at the distal end thereof and a curved surface forming member are used in combination.

FIG. 20 is an illustration for explaining the operation of a toner supply device wherein a slider element 15 with its one end attached to the distal end 12*a* of a conveying sheet 12 and the other end free is set to slide over ribs 24 (or rib 25). FIG. 21 an illustration for explaining the operation of a toner supply device wherein a slider element 15 folded in an approximately U-shape is attached to the distal end 12*a* of a conveying sheet 12 and this slider element 15 is set to slide over ribs 24 (or rib 25).

As has been detailed heretofore, according to the toner supply device of the present invention, the conveying sheet is long enough to come into sliding contact with the inner wall of the toner container while a slider element having a low frictional resistance is provided at the distal end of this conveying sheet. As a result, it is possible to convey the toner smoothly and hence improve the toner usage efficiency. Further, since it is possible to reduce high frequency sounds arising due to sliding contact even when the amount of toner in the toner container has decreased and hence grating sounds become easy to arise, it is possible to reduce uncomfortable noise. Thus, this configuration has achieved silent operation.

As the material presenting sliding performance, a soft resilient material, for example, a material having a rebound resilience of 80% or below is preferably used. Use of such material makes it possible to further lower the frictional resistance during sliding movement.

The slider element is preferably made up of a material presenting a low frictional resistance, specifically, having a coefficient of dynamic friction of 0.40 or below. Use of such material provides effective prevention against generation of grating sounds.

Setting the thickness of the slider element smaller than that of the conveying sheet makes it easy for the slider element to deform fitting along the aspect of the inner wall. Further, this thinness is advantageous for frictional resistance. Smallness of the absolute value of the coefficient of dynamic friction and the time-dependent increase of the dynamic friction makes it possible to reduce the loads on the drive system of the agitating element and the stress acting on the toner.

When cutouts are provided in the distal part of the slider element, it is possible to reduce the contact area between the slider element and the inner wall surface of the toner container. Accordingly, the contact friction can be reduced so that it is possible to smoothen the movement of the agitating element and conveying sheet, which leads to efficient conveyance of the toner.

When a series of openings is provided along the distal part of the slider element, it is possible to reduce the amount of toner scooped by the slider element, so that the resistance (the pressure of the toner) acting on the conveying sheet can be reduced, thus making it possible to smoothen the movement of the conveying sheet and agitating element.

When the slider element is folded in an approximately U-shape and fixed to the conveying sheet by both ends thereof so that the bent part extends beyond the distal part of the conveying sheet and covers the distal part of the conveying sheet, the state of contact with the inner wall of the toner container can be stabilized thus making it possible to smoothen the movement of the conveying sheet and agitating element. Further, since the slider element can be fixed firmly by its both ends, it is possible to prevent the slider element from dropping or peeling, thus leading to improvement of reliability.

When the distal part of the conveying sheet is bent in the rotational direction to form a bent portion while a slider element is attached to the bent portion so that it extends beyond the bent portion, the conveying sheet can be improved in rigidity and conveyance of the toner.

The toner supply device of the present invention is configured in such a manner that the curved surface forming member which defines a curved surface smoothly connecting between the top plate surface and the side wall surface is provided at the meeting position between the top plate and the side wall inside the toner container. Hence, the distal end of the deformed conveying sheet comes at least in, part into sliding contact with the curved surface forming sites of the curved surface forming member so that the full-length of the distal end of the conveying sheet approximately moves over the curved surface.

Accordingly, the deformation of the conveying sheet during the sliding movement over the top plate will not be released abruptly on the interior side of the toner container after the meeting point between the top plate and the side wall. Therefore, the conveying sheet smoothly transfers its contact point from the sliding movement over the top plate to the sliding movement over side wall, whereby it is possible to avoid the conveying sheet colliding with the side wall. Since the conveying sheet need not to have any cutouts and the distal part of the conveying sheet comes into sliding contact the inner wall contacting with toner, it is possible to hold and convey a sufficient amount of toner in a stable manner.

In this way, it is possible to suppress generation of uncomfortable noise resulting from collision of the conveying sheet against the inner wall whilst keeping its capability of conveying a sufficient amount of toner.

Another toner supply device according to the present invention is configured so that the curved surface forming member is comprised of a multiple number of plate-like ribs, arranged apart from one another in the direction perpendicular to the direction of the sliding movement of the conveying sheet, each rib being projected inward in the toner container from the top plate or from the side wall with its width put in the direction of the spacing and the end portions of the ribs on the interior side of the toner container are adapted to function as the curved surface forming sites.

Accordingly, only limited part of the distal end of the conveying sheet will come in contact with the curved surface forming member. Therefore, this configuration makes it possible to minimize damage to the conveying sheet due to its sliding movement over the curved surface forming member, stress acting on the toner and generation of grating sounds. Further, since the curved surface forming member is constituted by a multiple number of ribs, each being small, this configuration contributes to simplifying -the production with a metal die.

Further, a toner supply device according to the present invention is characterized in that the end portion of each rib on the interior side of the toner container has an end formed of a strip of curved surface that constitutes part of the curved surface and the ridges located at both sides of each end portion with respect to the spacing direction of the ribs are rounded.

Accordingly, it is possible to avoid interference of the distal end of the conveying sheet with the ribs. As a result, the distal end of the conveying sheet can smoothly move under reduced resistance to movement. Thus, this configuration contributes to inhibiting the conveying sheet from being damaged by the sliding movement over the curved surface forming member, the toner from being stressed and generation of grating sounds.

A toner supply device according to another aspect of the present invention is configured so that the end portion of each rib on the interior side of the toner container has an end formed of a curved ridgeline end that extends in the sliding direction of the conveying sheet and constitutes part of the curved surface and each end is rounded with respect to the direction of the spacing and the cross section of the distal end of each rib cut along a plane perpendicular to the end is angled or tapered.

Accordingly, it is possible to avoid interference of the distal end of the conveying sheet with the ribs as well as to reduce the area of the conveying sheet which comes in sliding contact with the ribs. As a result, this configuration is more effective in inhibiting the conveying sheet from being damaged due to its sliding movement over the curved surface forming member, the toner from being stressed and generation of grating sounds. Further, the configuration of the ribs being angled or tapered in section provides improvement in the durability of the metal die for producing the ribs of this shape, thus contributing to mass production and low cost.

A toner supply device according to still another aspect of the present invention is configured so that the end portion of each rib on the interior side of the toner container has a curved ridgeline end that extends in the sliding direction of the conveying sheet and constitutes part of the curved surface and the cross section of the distal end of each rib cut along a plane perpendicular to the end is approximately semicircular on the distal side.

Accordingly, it is possible to avoid interference of the distal end of the conveying sheet with the ribs as well as to reduce the area of the conveying sheet which comes in sliding contact with the ribs. As a result, this configuration is more effective in inhibiting the conveying sheet from being damaged due to its sliding movement over the curved surface forming member, the toner from being stressed and generation of grating sounds. Further, the configuration of the ribs being approximately semicircular in section provides marked improvement in the durability of the metal die for producing the ribs of this shape, thus further contributing to mass production and low cost.

Application of the conveying sheet with its distal end attached with any of the slider elements described above and the curved surface forming member in combination to a toner supply device makes it possible to obtain the combined effects and advantages as described above.

What is claimed is:

1. A toner supply device comprising:

an agitating element for agitating toner in a toner container;

a conveying sheet attached to one end portion of the agitating element and rotating with the agitating element to convey the toner to a predetermined position, wherein a distance from a proximal to a distal end of the conveying sheet is greater than a rotational radius of the agitating element and is set so that the distal end of the conveying sheet is put in sliding contact with an inner wall of the toner container by the agitating element being rotated; and a slider element provided at the distal end of the conveying sheet.

2. The toner supply device according to claim 1, wherein the slider element is made of a soft resilient material.

3. The toner supply device according to claim 2, wherein the slider element is made of a material having a rebound resilience of 80% or below.

4. The toner supply device according to claim 1, 2 or 3, wherein the slider element is made of a material having a coefficient of dynamic friction of 0.40 or below.

5. The toner supply device according to claim 1, 2 or 3, wherein a thickness of the slider element is smaller than that of the conveying sheet.

6. The toner supply device according to claim 1, 2 or 3, wherein cutouts are formed at a distal part of the slider element.

7. The toner supply device according to claim 6, wherein the cutouts are provided in a rectangular, wavy, saw-toothed or triangular form.

8. The toner supply device according to claim 1, 2 or 3, wherein a multiple number of openings are formed at a distal part of the slider element.

9. The toner supply device according to claim 1, 2 or 3, wherein the slider element is folded in an approximately U-shape and fixed to the conveying sheet by both ends thereof so that a bent part extends beyond the distal end of the conveying sheet and covers the distal end of the conveying sheet.

10. The toner supply device according to claim 1, 2 or 3, wherein the distal end of the conveying sheet is bent in a rotational direction thereof, forming a bent portion, and the slider element is attached so as to extend beyond the bent portion.

11. The toner supply device according to claim 10, wherein the slider element is attached to the front surface of the bent portion with respect to the rotational direction.

12. A toner supply device comprising:

a toner container for holding toner in a receptacle with a top plate;

an agitating element which is rotationally driven in a predetermined direction to agitate the toner in the toner container; and a conveying sheet joined to the agitating element and rotating with rotation of the agitating element while being deformed with its distal end put in sliding contact with, at least, the top plate of the toner container, a side wall connected to the top plate and an inner wall in contact with the toner, to thereby scoop up and bring the toner to a predetermined position, wherein a curved surface forming member for defining a curved surface smoothly connecting between a top plate surface and a side wall surface is provided at a meeting position between the top plate and the side wall inside the toner container so that a distal end of the deformed conveying sheet comes at least in part into sliding contact with curved surface forming sites of the curved surface forming member and a full-length of the distal end of the conveying sheet approximately moves over the curved surface.

13. The toner supply device according to claim 12, wherein the curved surface forming member is comprised of a multiple number of plate-like ribs, arranged apart from one another in a direction perpendicular to a direction of the sliding movement of the conveying sheet, each rib being projected inward in the toner container from the top plate or from the side wall with its width put in a direction of a spacing and end portions of the ribs on the interior side of the toner container are adapted to function as the curved surface forming sites.

14. The toner supply device according to claim 13, wherein the end portion of each rib on the interior side of the toner container has an end formed of a strip of curved surface that constitutes part of the curved surface and the ridges located at both sides of each end portion with respect to the spacing direction of ribs are rounded.

15. The toner supply device according to claim 13, wherein the end portion of each rib on the interior side of the toner container has a curved ridgeline end that extends in the sliding direction of the conveying sheet and constitutes part of the curved surface and each end is rounded with respect to the direction of the spacing and a cross section of the distal end of each rib cut along a plane perpendicular to the end is angled or tapered on the distal side.

16. The toner supply device according to claim 13, wherein the end portion of each rib on the interior side of the toner container has a curved ridgeline end that extends in the sliding direction of the conveying sheet and constitutes part of the curved surface and a cross section of the distal end of each rib cut along a plane perpendicular to the end is approximately semicircular on the distal side.

17. The toner supply device according to claim 12, further comprising:

a slider element provided at the distal end of the conveying sheet, wherein the slider element comes at least in part into sliding contact with the curved surface forming sites of the curved surface forming member and a full-length of a distal end approximately moves over the curved surface.

18. The toner supply device according to claim 17, wherein the slider element is made of a soft resilient material.

19. The toner supply device according to claim 18, wherein the slider element is made of a material having a rebound resilience of 80% or below.

20. The toner supply device according to claim 17, 18 or 19, wherein the slider element is made of a material having a coefficient of dynamic friction of 0.40 or below.

21. The toner supply device according to claim 17, 18 or 19, wherein a thickness of the slider element is smaller than that of the conveying sheet.

22. The toner supply device according to claim 17, 18 or 19, wherein cutouts are formed at a distal part of the slider element.

23. The toner supply device according to claim 22, wherein the cutouts are provided in a rectangular, wavy, saw-toothed or triangular form.

24. The toner supply device according to claim 17, 18 or 19, wherein a multiple number of openings are formed at the distal part of the slider element.

25. The toner supply device according to claim 17, 18 or 19, wherein the slider element is folded in an approximately U-shape and fixed to the conveying sheet by both ends thereof so that a bent part extends beyond the distal end of the conveying sheet and covers the distal end of the conveying sheet.

26. The toner supply device according to claim 17, 18 or 19, wherein the distal end of the conveying sheet is bent in a rotational direction thereof, forming a bent portion, and the slider element is attached so as to extend beyond the bent portion.

27. The toner supply device according to claim 26, wherein the slider element is attached to the front surface of the bent portion with respect to the rotational direction.

28. The toner supply device according to claim 1, wherein the slider element is made of a material having a lower resistance of friction than that of the conveying sheet.

* * * * *